US012480328B2

(12) United States Patent
Schneider et al.

(10) Patent No.: US 12,480,328 B2
(45) Date of Patent: Nov. 25, 2025

(54) SYSTEM AND METHOD FOR VERTICAL AND HORIZONTAL IN-FILL INSTALLATION

(71) Applicant: Barrette Outdoor Living, Inc., Middleburg Heights, OH (US)

(72) Inventors: Christopher Michael Schneider, Linwood, NJ (US); Paige Barbara Moore, Absecon, NJ (US)

(73) Assignee: Barrette Outdoor Living, Inc., Middleburg Heights, OH (US)

( * ) Notice: Subject to any disclaimer, the term of this patent is extended or adjusted under 35 U.S.C. 154(b) by 0 days.

(21) Appl. No.: 18/390,348

(22) Filed: Dec. 20, 2023

(65) Prior Publication Data

US 2024/0392601 A1 Nov. 28, 2024

Related U.S. Application Data

(63) Continuation of application No. 17/338,914, filed on Jun. 4, 2021, now Pat. No. 11,891,832.

(60) Provisional application No. 63/035,391, filed on Jun. 5, 2020.

(51) Int. Cl.
*E04H 17/14* (2006.01)

(52) U.S. Cl.
CPC ..... *E04H 17/1456* (2021.01); *E04H 17/1488* (2021.01)

(58) Field of Classification Search
CPC ..... E04H 17/1413; E04H 17/1417; E04H 17/1447; E04H 17/1452; E04H 17/1456; E04H 17/1465; E04H 17/1469; E04H 17/1478; E04H 17/1479; E04H 17/1488; E04H 17/16; E04H 17/1602; E04H 17/17; E04H 17/1786; E04H 17/185; E04H 17/20; E04H 17/22
See application file for complete search history.

(56) References Cited

U.S. PATENT DOCUMENTS

| | | | |
|---|---|---|---|
| 3,037,593 | A | 6/1962 | Webster |
| 3,452,262 | A | 6/1969 | Helmut et al. |
| 4,369,953 | A | 1/1983 | Greiner et al. |
| 4,809,955 | A | 3/1989 | Veilleux |

(Continued)

FOREIGN PATENT DOCUMENTS

| | | | |
|---|---|---|---|
| DE | 202014000716 U1 * | 4/2014 | ..... E04H 17/168 |
| EP | 3399123 B1 * | 12/2019 | ..... E01D 22/00 |

(Continued)

*Primary Examiner* — Amber R Anderson
*Assistant Examiner* — Kevin J Baynes
(74) *Attorney, Agent, or Firm* — John Maldjian, Esq.; Stevens & Lee PC

(57) ABSTRACT

Disclosed is a fence system. The fence system, comprising: a first post; a second post, wherein each of the first post and the second post comprises a first set of ribs and a second set of ribs; a lower rail, wherein a first end of the lower rail is adapted to terminate at a face of the first set of ribs of the first post and a second end of the lower rail is adapted to terminate at a face of the first set of ribs of the second post; and an upper rail, wherein the lower rail and the upper rail are positioned to receive one or more infill boards, such that the one or more infill boards are adapted to terminate at a face of the second set of ribs of the first post and at a face of the second set of ribs of the second post.

19 Claims, 25 Drawing Sheets

(56) References Cited

U.S. PATENT DOCUMENTS

| | | | | |
|---|---|---|---|---|
| 5,078,367 | A | 1/1992 | Simpson et al. | |
| 5,702,090 | A | 12/1997 | Edgman | |
| 6,478,287 | B2 | 11/2002 | Desouza | |
| 6,772,998 | B2 | 8/2004 | Bebendorf | |
| 6,945,517 | B2 | 9/2005 | Augur | |
| 7,040,605 | B2 | 5/2006 | Lappen | |
| 7,690,629 | B1 * | 4/2010 | Briggs | E04H 17/168 256/65.12 |
| 7,934,699 | B2 | 5/2011 | Zell et al. | |
| 8,132,791 | B2 | 3/2012 | Stucker | |
| 9,149,894 | B2 | 10/2015 | Richison et al. | |
| 9,506,270 | B2 | 11/2016 | Eric et al. | |
| 2003/0213947 | A1 | 11/2003 | Takagi et al. | |
| 2006/0113517 | A1 | 6/2006 | Colantonio et al. | |
| 2009/0152523 | A1 | 6/2009 | Erwin | |
| 2010/0200825 | A1 | 8/2010 | Hill | |
| 2010/0243369 | A1 | 9/2010 | Fusiek et al. | |
| 2010/0314596 | A1 | 12/2010 | Thomas | |
| 2011/0209436 | A1 | 9/2011 | Fabbri | |
| 2016/0305150 | A1 | 10/2016 | Volin et al. | |
| 2017/0058557 | A1 | 3/2017 | Wu | |
| 2017/0211272 | A1 * | 7/2017 | Cullinan | E04H 17/1413 |
| 2019/0177998 | A1 | 6/2019 | Sheehan | |
| 2019/0284833 | A1 | 9/2019 | Yeh et al. | |
| 2021/0363712 | A1 | 11/2021 | Wilson et al. | |
| 2021/0395964 | A1 | 12/2021 | Wilson et al. | |

FOREIGN PATENT DOCUMENTS

| | | | | |
|---|---|---|---|---|
| FR | 3005079 | A1 | 10/2014 | |
| FR | 3041016 | A3 | 3/2017 | |
| GB | 1536546 | A * | 12/1978 | E04H 17/006 |
| GB | 2247901 | A | 3/1992 | |
| GB | 2541955 | A | 3/2017 | |
| WO | 2013089560 | A2 | 6/2013 | |
| WO | 2016180032 | A1 | 11/2016 | |

* cited by examiner

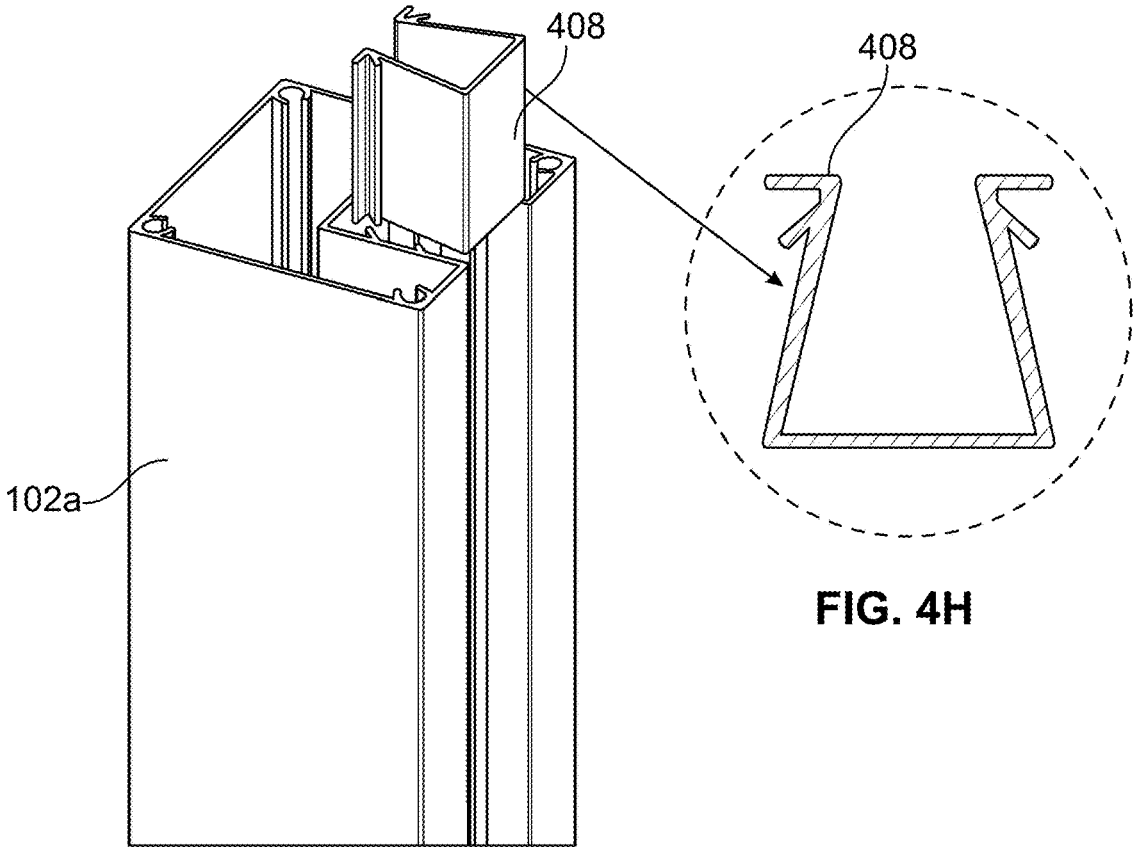
FIG. 4H
FIG. 4D
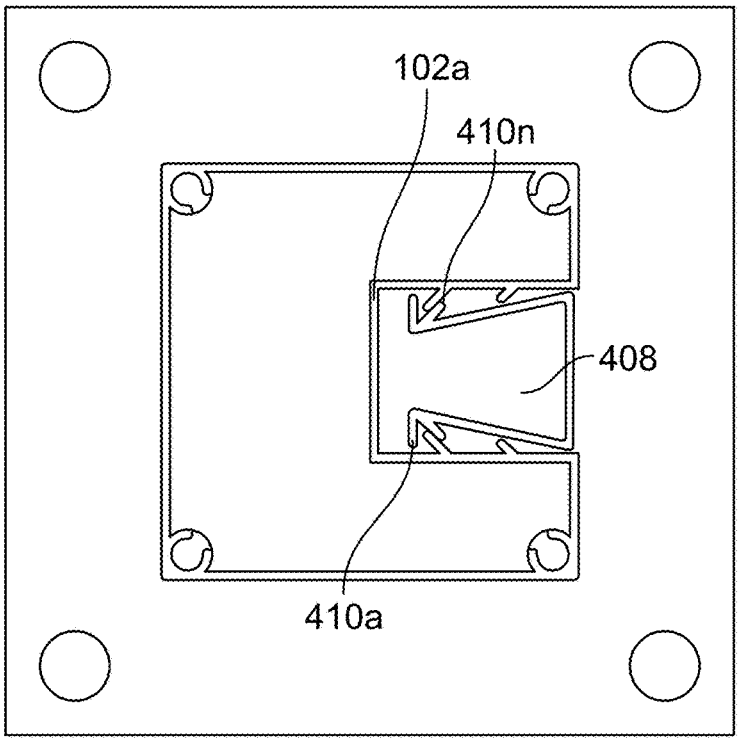
FIG. 4E

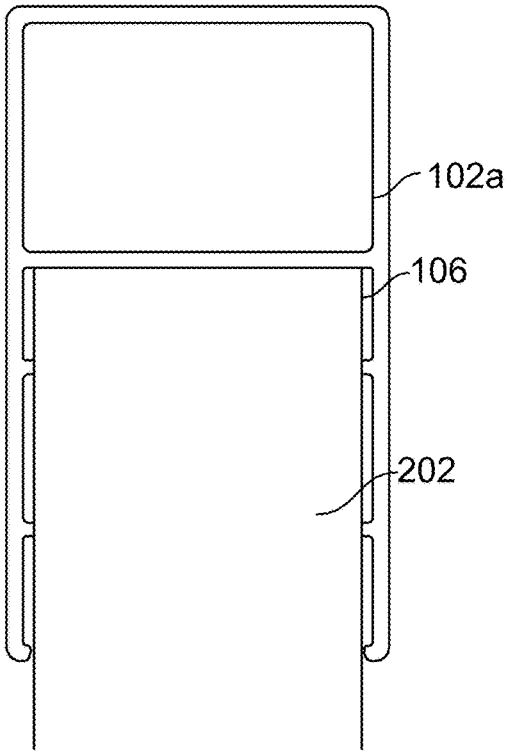
FIG. 6E
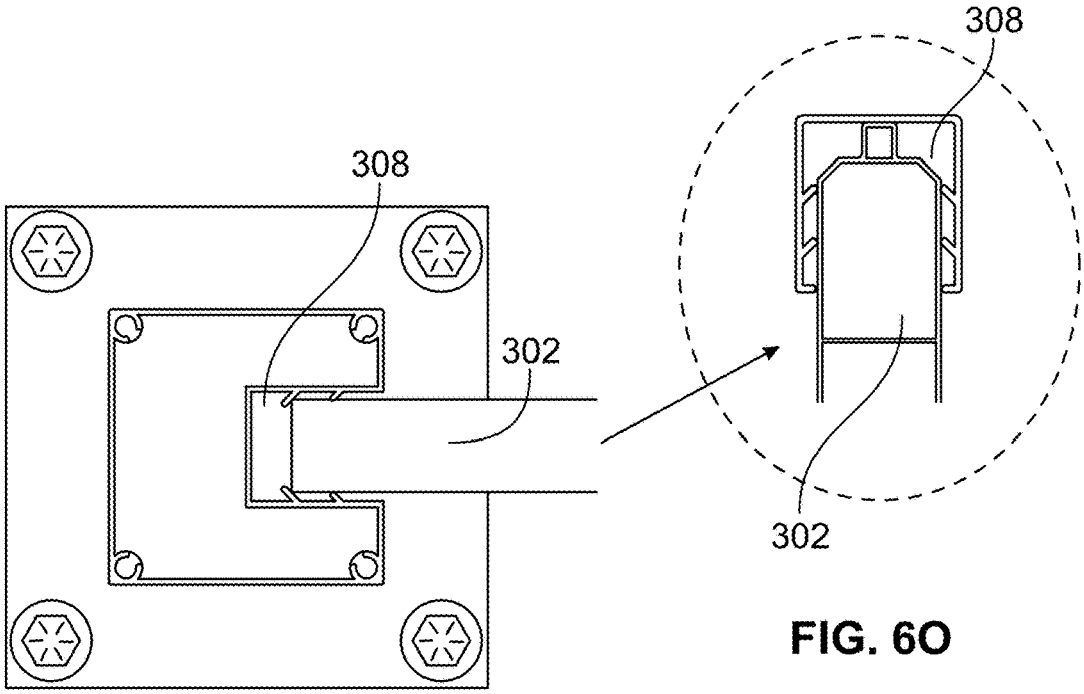
FIG. 6O
FIG. 6F

SYSTEM AND METHOD FOR VERTICAL AND HORIZONTAL IN-FILL INSTALLATION

CROSS-REFERENCE TO RELATED APPLICATIONS

This application is a continuation of U.S. Ser. No. 17/338,914, filed Jun. 4, 2021, entitled, "SYSTEM AND METHOD FOR VERTICAL AND HORIZONTAL IN-FILL INSTALLATION", which claims the benefit of U.S. Provisional Application Ser. No. 63/035,391 filed Jun. 5, 2020, entitled "SYSTEM AND METHOD FOR VERTICAL AND HORIZONTAL IN-FILL INSTALLATION", which are incorporated herein by reference in their entirety.

FIELD OF INVENTION

Embodiments disclosed herein relate, in general, to a fencing and privacy screening, and more particularly, to a fence system and a method of installing the same.

BACKGROUND

Fences are well known in an art for providing security to a user's property. Post fencing is one of a common type of fence. When installing the fence, fence posts are typically positioned in holes into a ground and then sealed in place with a concrete poured into these holes, such that a substantial length of each of the fence posts is below a ground surface.

Traditionally, metal fences have been installed in between the fence posts, but primarily they have been chain link fences. Although, the metal fences are long lasting and requires no effort for installation, however, they do not provide privacy. Further, in another traditional approach, the fences that are made of a steel material has been installed in between the fence posts. However, the steel material can rust with time unless it is periodically chemically treated to prevent the rust. Moreover, the steel material involves a higher cost, which makes such type of the fences a bit expensive. Moreover, some of the fences are installed permanently, due to which it is difficult to remove from the fence posts when the installed fences require replacement.

Therefore, there is a need for a fence system and a method of installing the same that can administer the drawbacks faced by conventional systems.

SUMMARY

Embodiments in accordance with the present invention provide a fence system. The fence system, comprising: a first post. The fence system further comprising: a second post, such that the first post and the second post are positioned at pre-defined locations, wherein each of the first post and the second post comprises a first set of ribs and a second set of ribs. The fence system further comprising: a lower rail positioned between the first post and the second post, wherein a first end of the lower rail is adapted to terminate at a face of the first set of ribs of the first post and a second end of the lower rail is adapted to terminate at a face of the first set of ribs of the second post. The fence system further comprising: an upper rail positioned between the first post and the second post, wherein the lower rail and the upper rail are positioned to receive one or more infill boards, such that the one or more infill boards are adapted to terminate at a face of the second set of ribs of the first post and at a face of the second set of ribs of the second post.

Embodiments in accordance with the present invention further provide a fence system. The fence system, comprising: a first post. The fence system further comprising: a second post, such that the first post and the second post are positioned at pre-defined locations, wherein each of the first post and the second post comprises a first set of ribs and a second set of ribs. The fence system further comprising: a lower rail positioned between the first post and the second post, wherein a first end of the lower rail is adapted to terminate at a face of the first set of ribs of the first post and a second end of the lower rail is adapted to terminate at a face of the first set of ribs of the second post. The fence system further comprising: an upper rail positioned between the first post and the second post, wherein the lower rail and the upper rail are positioned to receive one or more infill boards in one of a horizontal orientation or a vertical orientation, such that the one or more infill boards are adapted to terminate at a face of the second set of ribs of the first post and at a face of the second set of ribs of the second post.

Embodiments in accordance with the present invention further provide a method for installation of one or more infill boards. The method comprising steps of: installing a first post and a second post at pre-defined locations; positioning a lower rail between the first post and the second post, such that a first end of the lower rail is adapted to terminate at a face of a first set of ribs of the first post and a second end of the lower rail is adapted to terminate at a face of the first set of ribs of the second post; inserting one or more infill boards over the lower rail into corresponding grooves of the first post and the second post, such that the one or more infill boards are adapted to terminate at a face of a second set of ribs of the first post and at a face of the second set of ribs of the second post; and attaching an upper rail over the one or more infill boards by using a fastening means.

Embodiments of the present invention may provide a number of advantages depending on its particular configuration. Embodiments of the present invention may provide a fence system that is provided with vinyl infill boards that lasts for many years and in all kinds of weather. Further, embodiments of the present invention may provide a fence system that is provided with wooden infill boards that are resistant to moisture and not be affected by a dry air. Next, embodiments of the present invention may provide a fence system that is provided with infill boards that may be installed in a horizontal orientation or a vertical orientation based on a user's choice. Next, embodiments of the present invention may provide a fence system that is provided with a support member to hold a lower rail which in further provides a support to one or more infill boards.

These and other advantages will be apparent from the present application of the embodiments described herein.

The preceding is a simplified summary to provide an understanding of some embodiments of the present invention. This summary is neither an extensive nor exhaustive overview of the present invention and its various embodiments. The summary presents selected concepts of the embodiments of the present invention in a simplified form as an introduction to the more detailed description presented below. As will be appreciated, other embodiments of the present invention are possible utilizing, alone or in combination, one or more of the features set forth above or described in detail below.

BRIEF DESCRIPTION OF THE DRAWINGS

The foregoing and other aspects of the embodiments disclosed herein are best understood from the following detailed description when read in connection with the accompanying drawings. For the purpose of illustrating the embodiments disclosed herein, there is shown in the drawings embodiments that are presently preferred, it being understood, however, that the embodiments disclosed herein are not limited to the specific instrumentalities disclosed. Included in the drawings are the following figures:

FIG. 4D illustrates a support member, according to an embodiment of the present invention;

FIG. 4E illustrates an installation of the support member, according to an embodiment of the present invention;

FIG. 4H illustrates a zoomed in partial view of a support member according to an embodiment of the present invention;

FIG. 6E illustrates an installation of a first wooden infill board, according to an embodiment of the present invention;

FIG. 6F illustrates an installation of the vinyl infill boards, according to an embodiment of the present invention;

FIG. 6O illustrates a partial top zoomed-in view of an installation of the vinyl infill boards according to an embodiment of the present invention;

FIG. 6P illustrates a partial top zoomed-in view of an installation of a post adaptor in a post according to an embodiment of the present invention;

Figures 1A, 1C:
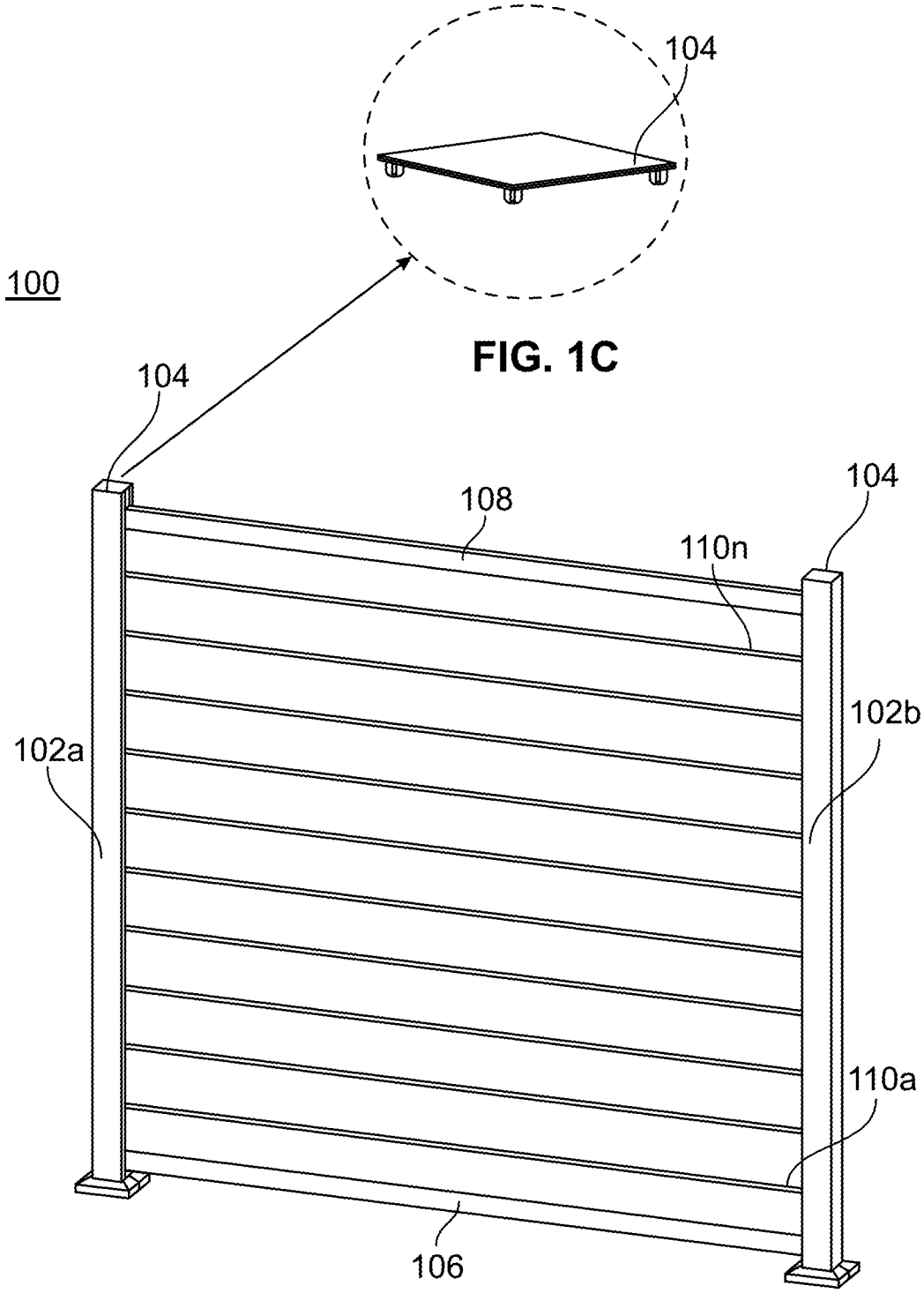
FIG. 1A illustrates a fence system, according to an embodiment of the present invention.
FIG. 1C illustrates a zoomed in partial view of a post cap for use in an embodiment of the fence system of the present invention.

While embodiments of the present invention are described herein by way of example using several illustrative drawings, those skilled in the art will recognize the present invention is not limited to the embodiments or drawings described. It should be understood the drawings and the detailed description thereto are not intended to limit the present invention to the particular form disclosed, but to the contrary, the present invention is to cover all modification, equivalents and alternatives falling within the spirit and scope of embodiments of the present invention as defined by the appended claims.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

Embodiments of the present invention will be described below in conjunction with an exemplary fence system. Embodiments of the present invention are not limited to any particular type of fence system. Those skilled in the art will recognize the disclosed techniques may be used in any fence system.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

FIG. 1A illustrates a fence system 100, according to an embodiment of the present invention. In an embodiment of the present invention, the fence system 100 may comprise a first post 102*a* and a second post 102*b* that may be positioned at pre-defined locations. In an embodiment of the present invention, the first post 102*a* may be one of, a line post, a corner post, or an end post. Similarly, the second post 102*b* may be one of, the line post, the corner post, or the end post. The first post 102*a* and the second post 102*b* may be made up of a material such as, but not limited to, a metal, a steel, wood, and so forth. Embodiments of the present invention are intended to include or otherwise cover any type of the material of the first post 102*a* and the second post 102*b* including known, related art, and/or later developed technologies that may be beneficial to provide a support to the fence system 100. In an embodiment of the present invention, a height of each of the first post 102*a* and the second post 102*b* may be in a range of 36 inches to 71 inches. In a preferred embodiment of the present invention, the height of the each of the first post 102*a* and the second post 102*b* may be 71 inches. Further, in an embodiment of the present invention, a length from the first post 102*a* to the second post 102*b* may be in a range of 36 inches to 73 inches. In a preferred embodiment of the present invention, the length from the first post 102*a* to the second post 102*b* may be 72.6 inches.

Further, in an embodiment of the present invention, the fence system 100 may comprise a post cap 104 that may be designed to cover a top end of the each of the first post 102*a* and the second post 102*b*. In an embodiment of the present invention, the post cap 104 (as shown in a zoomed view the FIG. 1A of FIG. 1C) may be designed for the line post. In another embodiment of the present invention, the post cap 104 may be designed for the end post. In an embodiment of the present invention, the post cap 104 may be made up of a material such as, but not limited to, a steel, a copper, a stainless steel, and so forth. Embodiments of the present invention are intended to include or otherwise cover any type of the material of the post cap 104 including known, related art, and/or later developed technologies. The fence system 100 may further comprise a lower rail 106 and an upper rail 108 that may be positioned between the first post 102*a* and the second post 102*b*, in an embodiment of the present invention. In an embodiment of the present invention, the lower rail 106 and the upper rail 108 may be positioned in a horizontal orientation in between the first post 102*a* and the second post 102*b*. The lower rail 106 and the upper rail 108 may be positioned to receive one or more infill boards 110*a*-110*n* (hereinafter referred to as the infill boards 110), in an embodiment of the present invention. In an embodiment of the present invention, the lower rail 106 and the upper rail 108 may be positioned to receive the infill boards 110 in the horizontal orientation along the length from the first post 102*a* to the second post 102*b*.

Further, in an embodiment of the present invention, a length of each of the lower rail 106 and the upper rail 108 may be in a range of 36 inches to 71 inches. In a preferred embodiment of the present invention, the length of the each of the lower rail 106 and the upper rail 108 may be 70.05 inches. In an embodiment of the present invention, the lower rail 106 and the upper rail 108 may be made up of a material such as, but not limited to, a stainless steel, a brass, a copper, an aluminium, and so forth. Embodiments of the present invention are intended to include or otherwise cover any material for the lower rail 106 and the upper rail 108, including known, related art, and/or later developed technologies.

According to an embodiment of the present invention, the infill boards 110 may be made up of a material such as, but not limited to, a wooden material, a vinyl material, and so forth. Embodiments of the present invention are intended to include or otherwise cover any material for the infill boards 110, including known, related art, and/or later developed technologies. Further, in an embodiment of the present invention, a distance from a top of the post cap 104 to a top of the upper rail 108 may be in a range of 1.25 inches to 6.5 inches. In a preferred embodiment of the present invention, the distance from the top of the post cap 104 to the top of the upper rail 108 may be 1.43 inches.

Figures 1B, 1D:
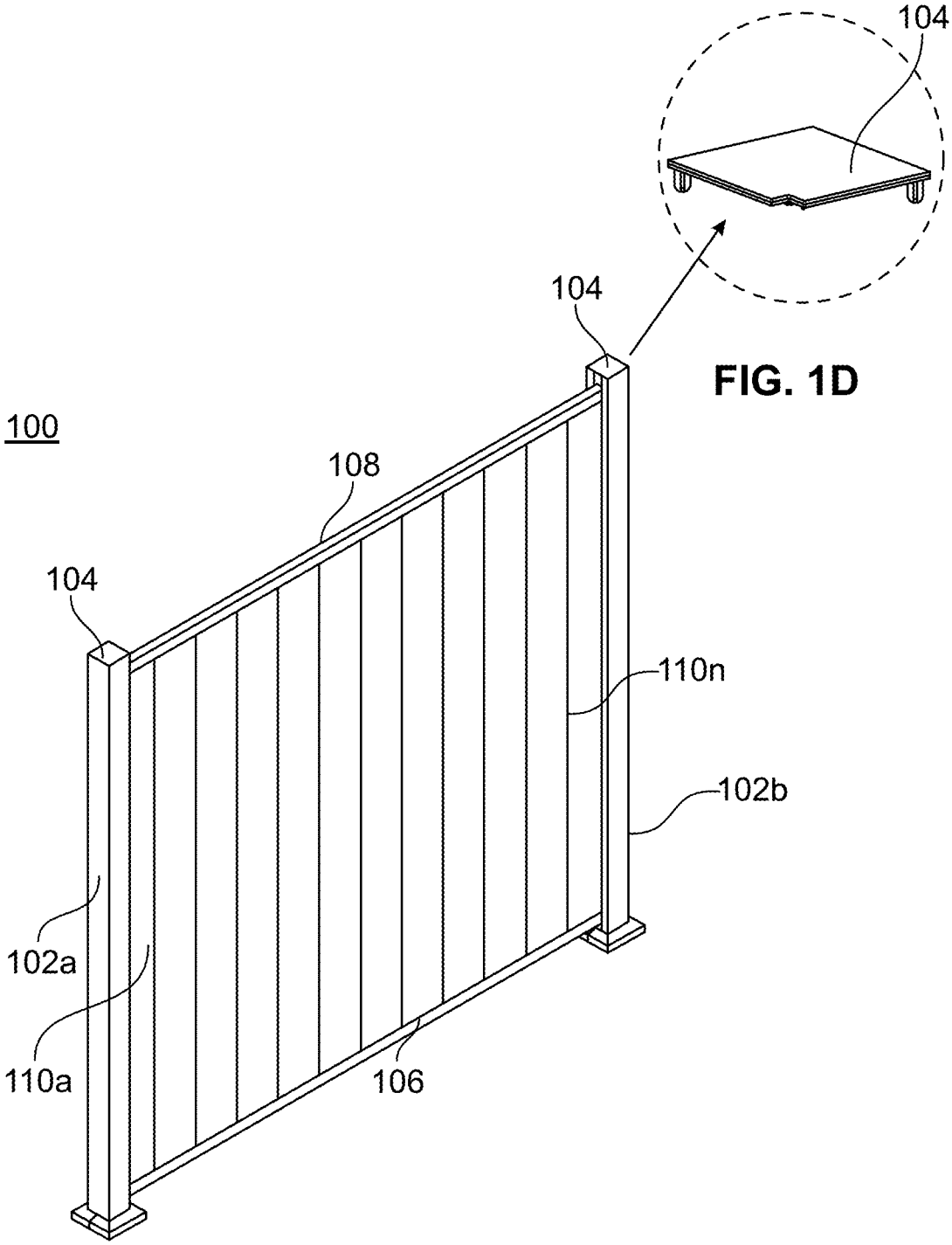
FIG. 1B illustrates the fence system, according to another embodiment of the present invention.
FIG. 1D illustrates a zoomed in partial view of a post cap for use in an embodiment of the fence system of the present invention.

FIG. 1B illustrates the fence system 100, according to another embodiment of the present invention. The fence system 100 may comprise the post cap 104 that may be designed to cover the top end of the each of the first post 102*a* and the second post 102*b*, as discussed above. In an embodiment of the present invention, the post cap 104 (as shown in a zoomed view of FIG. 1D of the FIG. 1B) may be designed for the corner post. In an embodiment of the present invention, the lower rail 106 and the upper rail 108 may be positioned horizontally in between the first post 102*a* and the second post 102*b* to receive the infill boards 110 in a vertical orientation along the height of the each of the first post 102*a* and the second post 102*b*. In such embodiment of the present invention, the infill boards 110 may be inserted in the vertical orientation starting from a first side to a second side. In an embodiment of the present invention, the first side may be a left side that may be starting from the first post 102*a* and the second side may be a right side that may be ended at the second post 102*b*. In another embodiment of the present invention, the first side may be the right side that may be starting from the second post 102*b* and the second side may be the left side that may be ended at the first post 102*a*.

Figure 2A:
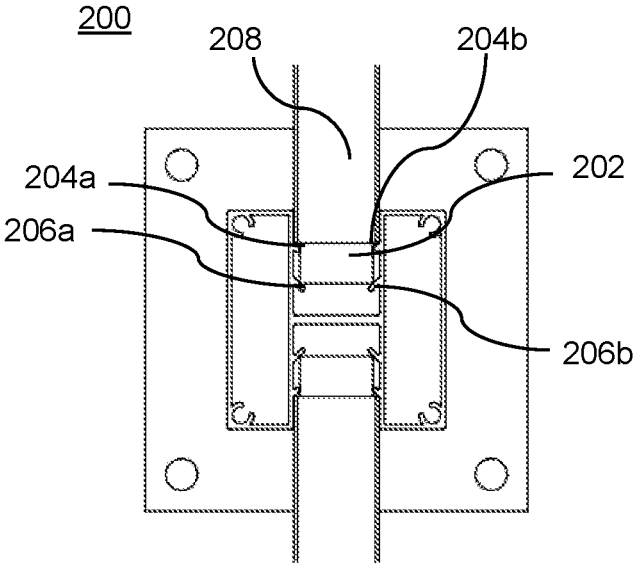
FIG. 2A illustrates a line post for wooden infill boards, according to an embodiment of the present invention.

FIG. 2A illustrates a line post 200 for wooden infill boards 202, according to an embodiment of the present invention. The line post 200 may be a simple slotted 3 inches post EPN-0865, according to an embodiment of the present invention. In an embodiment of the present invention, the line post 200 may be the first post 102*a* (as shown in the FIG. 1A), the second post 102*b* (as shown in the FIG. 1A), or a combination thereof. In an embodiment of the present invention, the height of the line post 200 may be 71 inches. Further, the line post 200 may be available in 71 inches surface mount, 42 inches surface mount, 99 inches in-ground, according to an embodiment of the present invention. In an embodiment of the present invention, the line post 200 may comprise 1.7-inch×2 inches U channel for the wooden infill boards 202.

The line post 200 may further comprise a first set of ribs 204*a*-204*b* (hereinafter referred to as the first set of ribs 204) and a second set of ribs 206*a*-206*b* (hereinafter referred to as the second set of ribs 206), in an embodiment of the present invention. In an embodiment of the present invention, a first end and a second end of a rail 208 may terminate at a face of the first set of ribs 204 of the corresponding line post 200, upon installation of the rail 208 into the line post 200. In an embodiment of the present invention, the first end of the rail 208 may terminate at the face of the first set of ribs 204 of the line post 200 that may be the first post 102*a* and the second end of the rail 208 may terminate at the face of the first set of ribs 204 of the line post 200 that may be the second post 102*b*.

Further, in an embodiment of the present invention, a first end and a second end of each of the wooden infill boards 202 may terminate at a face of the second set of ribs 206 of the line post 200, upon installation of the wooden infill boards 202 into the line post 200. In an embodiment of the present invention, the first end of the each of the wooden infill boards 202 may terminate at the face of the second set of ribs 206 of the line post 200 that may be the first post 102*a* and the second end of the each of the wooden infill boards 202 may terminate at the face of the second set of ribs 206 of the line post 200 that may be the second post 102*b*.

In an embodiment of the present invention, the first end and the second end of the each of the wooden infill boards 202 may be placed tightly in between the first set of ribs 204 of the corresponding line post 200 to enable the wooden infill boards 202 to have strong engagement inside the line post 200. In an embodiment of the present invention, a length of the first end and the second end of the each of the wooden infill boards 202 may be 1 inch.

The wooden infill boards 202 may be installed in a horizontal orientation, in an embodiment of the present invention. In such embodiment of the present invention, the wooden infill boards installed in the horizontal orientation may provide a full privacy or a semi-privacy to a user. In another embodiment of the present invention, the wooden infill boards 202 may be installed in a vertical orientation. In such embodiment of the present invention, the vertically installed wooden infill boards may provide the full privacy to the user. In an embodiment of the present invention, a height of the wooden infill boards 202 may be in a range of 5 inches to 6 inches. In an embodiment of the present invention, a length of the each of the wooden infill boards 202 that may be the horizontally installed wooden infill boards may be in a range of 36 inches to 72 inches. In an alternative embodiment of the present invention, the length of the each of the wooden infill boards 202 that may be the vertically installed wooden infill boards may be in a range of 36 inches to 66 inches.

Figure 2B:
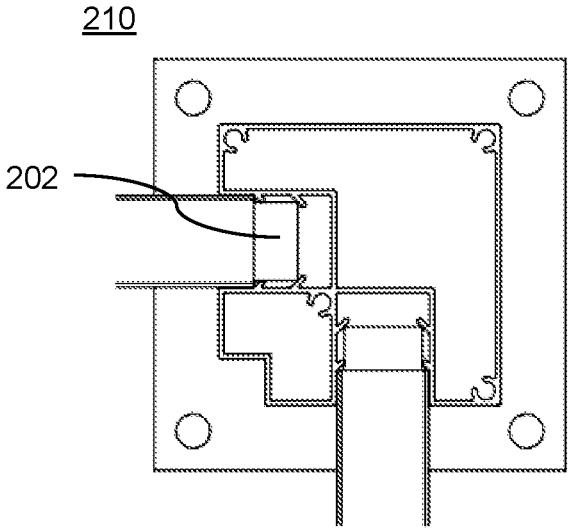
FIG. 2B illustrates a corner post for the wooden infill boards, according to an embodiment of the present invention.

FIG. 2B illustrates a corner post 210 for the wooden infill boards 202, according to an embodiment of the present invention. The corner post 210 may be a simple slotted 3.6 inches post EPN-0866, according to an embodiment of the present invention. In an embodiment of the present invention, the corner post 210 may be the first post 102*a* (as shown in the FIG. 1A), the second post 102*b* (as shown in the FIG. 1A), or a combination thereof. Further, the corner post 210 may be available in, but not limited to, a 71 inches surface mount, a 42 inches surface mount, a 99 inches in-ground, and so forth, according to an embodiment of the present invention. In a preferred embodiment of the present invention, the height of the corner post 210 may be 42 inches.

Figure 2C:
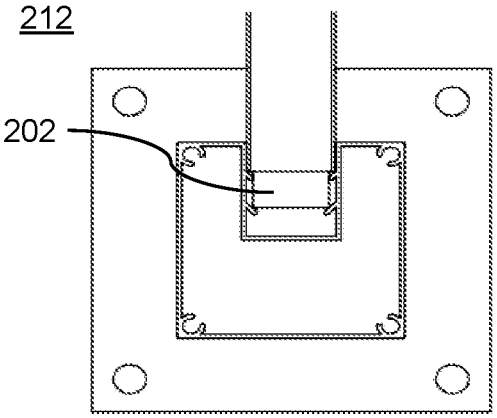
FIG. 2C illustrates an end post for the wooden infill boards, according to an embodiment of the present invention.

FIG. 2C illustrates an end post 212 for the wooden infill boards 202, according to an embodiment of the present invention. The end post 212 may be a simple slotted 3 inches post EPN-0873, according to an embodiment of the present invention. In an embodiment of the present invention, the end post 212 may be the first post 102*a* (as shown in the FIG. 1A), the second post 102*b* (as shown in the FIG. 1A), or a combination thereof. Further, the end post 212 may be available in the 71 inches surface mount, the 42 inches surface mount, the 99 inches in-ground, according to an embodiment of the present invention. In a preferred embodiment of the present invention, a height of the end post 212 may be 99 inches.

Figure 3A:
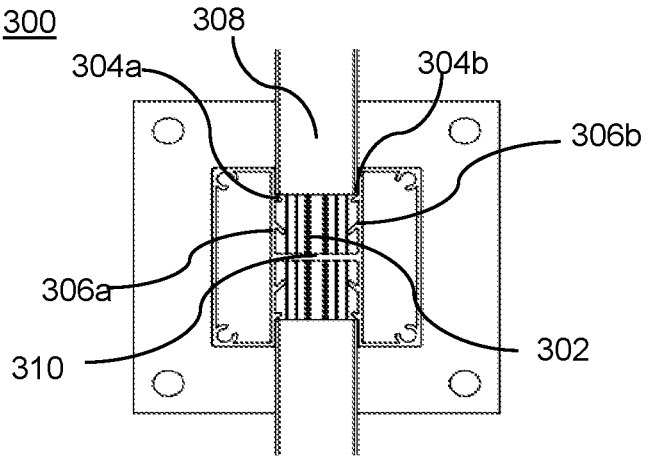
FIG. 3A illustrates a line post for vinyl infill boards, according to an embodiment of the present invention.

FIG. 3A illustrates a line post 300 for vinyl infill boards 302, according to an embodiment of the present invention. The line post 300 may be a simple slotted 3 inches post, according to an embodiment of the present invention. In an embodiment of the present invention, the line post 300 may be the first post 102*a* (as shown in the FIG. 1A), the second post 102*b* (as shown in the FIG. 1A), or a combination thereof. Further, the line post 300 may be available in, but not limited to, a 71 inches surface mount, a 42 inches surface mount, a 99 inches in-ground, and so forth, according to an embodiment of the present invention. In an embodiment of the present invention, the line post 300 may comprise 1.7-inch×1.25 inches U channel for the vinyl infill boards 302. The line post 300 may further comprise a first pair of ribs 304*a*-304*b* (hereinafter referred to as the first pair of ribs 304) and a second pair of ribs 306*a*-306*b* (hereinafter referred to as the second pair of ribs 306), in an embodiment of the present invention. In an embodiment of the present invention, a first end and a second end of a rail 308 may terminate at a face of the first set of ribs 304 of the corresponding line post 300, upon installation of the rail 308 into the line post 300. In an embodiment of the present invention, the first end of the rail 308 may terminate at the face of the first set of ribs 304 of the line post 300 that may be the first post 102*a* and the second end of the rail 308 may terminate at the face of the first set of ribs 304 of the line post 300 that may be the second post 102*b*. Further, in an embodiment of the present invention, a first end and a second end of each of the vinyl infill boards 302 may terminate at a center wall 310 of the corresponding line post 300, upon installation of the vinyl infill boards 302 into the line post 300. In an embodiment of the present invention, the first end of the each of the vinyl infill boards 302 may terminate at the center wall 310 of the line post 300 that may be the first post 102*a* and the second end of the each of the vinyl infill boards 302 may terminate at the center wall 310 of the line post 300 that may be the second post 102*b*. In an embodiment of the present invention, the first end and the second end of the each of the vinyl infill boards 302 may be placed tightly in between the second set of ribs 306 of the corresponding line post 300, to enable the vinyl infill boards 302 to have strong engagement inside the line post 300. In an embodiment of the present invention, a length of the first end and the second end of the each of the vinyl infill boards 302 may be ⅞ inches.

The vinyl infill boards 302 may be horizontally installed vinyl infill boards, in an embodiment of the present invention. In another embodiment of the present invention, the vinyl infill boards 302 may be vertically installed vinyl infill boards. In an embodiment of the present invention, a length of the vinyl infill boards 302 that may be the vertically installed vinyl infill boards may be in a range of 36 inches to 67 inches, when the line post 300 is available in one of, the 71 inches surface mount or the 99 inches in-ground. In an alternative embodiment of the present invention, the length of the vinyl infill boards 302 that may be the vertically installed vinyl infill boards may be 38 inches, when the line post 300 is available in the 42 inches surface mount.

Figure 3B:
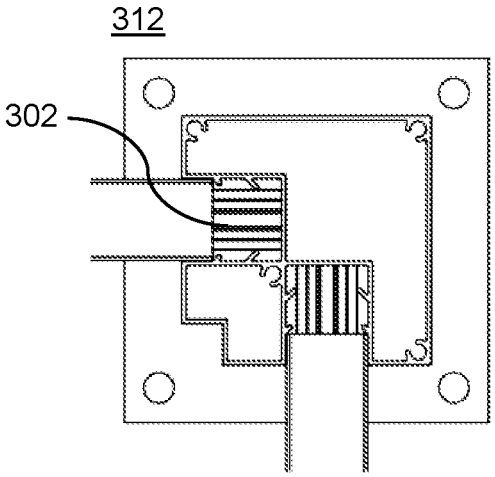
FIG. 3B illustrates a corner post for the vinyl infill boards, according to an embodiment of the present invention.

FIG. 3B illustrates a corner post 312 for the vinyl infill boards 302, according to an embodiment of the present invention. The corner post 312 may be a simple slotted 3.6 inches post, according to an embodiment of the present invention. In an embodiment of the present invention, the corner post 312 may be the first post 102*a* (as shown in the FIG. 1A), the second post 102*b* (as shown in the FIG. 1A), or a combination thereof. Further, the corner post 312 may be available in, but not limited to, a 71 inches surface mount, a 42 inches surface mount, a 99 inches in-ground, and so forth, according to an embodiment of the present invention.

Figure 3C:
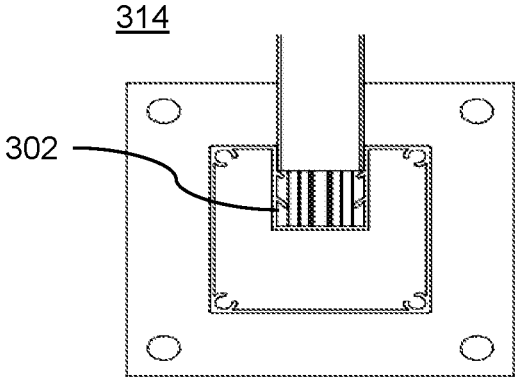
FIG. 3C illustrates an end post for the vinyl infill boards, according to an embodiment of the present invention.

FIG. 3C illustrates an end post 314 for the vinyl infill boards 302, according to an embodiment of the present invention. The end post 314 may be a simple slotted 3 inches post, according to an embodiment of the present invention. In an embodiment of the present invention, the end post 314 may be the first post 102*a* (as shown in the FIG. 1A), the second post 102*b* (as shown in the FIG. 1A), or a combination thereof. Further, the end post 314 may be available in, but not limited to, a 71 inches surface mount, a 42 inches surface mount, a 99 inches in-ground, etc., according to an embodiment of the present invention.

Figure 4A:
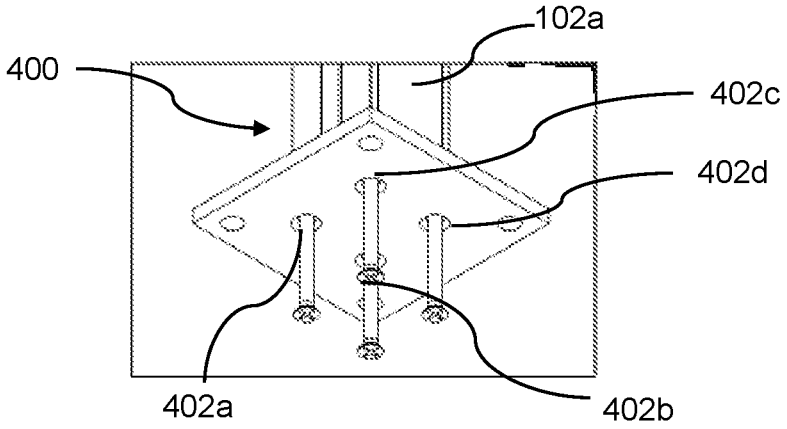
FIG. 4A illustrates a base plate of the fence system, according to an embodiment of the present invention.

FIG. 4A illustrates a base plate 400 of the fence system 100, according to an embodiment of the present invention. In an embodiment of the present invention, the base plate 400 may be drilled with a plurality of screw bosses 402*a*-402*d* (hereinafter referred to as the screw bosses 402) by using a drilling equipment. In an embodiment of the present invention, the drilling equipment may be provided in a surface mount kit of the fence system 100, in an embodiment of the present invention. In an embodiment of the present invention, the drilling equipment may be, but not limited to, a Philips drill bit, a high-speed drill bit of ⅛ inches, a drive bit, #3×2 inches Phillips's driver, 5/16 inches hex head driver, and so forth. Embodiments of the present invention are intended to include or otherwise cover any type of the drilling equipment, including known, related art, and/or later developed technologies that may be beneficial to drill the screw bosses 402 of the base plate 400. In an embodiment of the present invention, the screw bosses 402 may be pre-tapped on a bottom end of the first post 102*a* for case of installation. In such embodiment of the present invention, the bottom end of the first post 102*a* may be installed onto the corresponding base plate 400 through the screw bosses 402. Similarly, a bottom end of the second post 102*b* may be installed onto the corresponding base plate 400 through the screw bosses 402.

In an embodiment of the present invention, the base plate 400 may be made up of a material such as, but not limited to, a stainless steel, a mild steel, and so forth. Embodiments of the present invention are intended to include or otherwise cover any material for the base plate 400, including known, related art, and/or later developed technologies. Further, in an embodiment of the present invention, the base plate 400 may be of any shape such as, but not limited to, a square shape, a rectangular shape, a triangular shape, and so forth. Embodiments of the present invention are intended to include or otherwise cover any shape of the base plate 400, including known, related art, and/or later developed technologies.

Figure 4B:
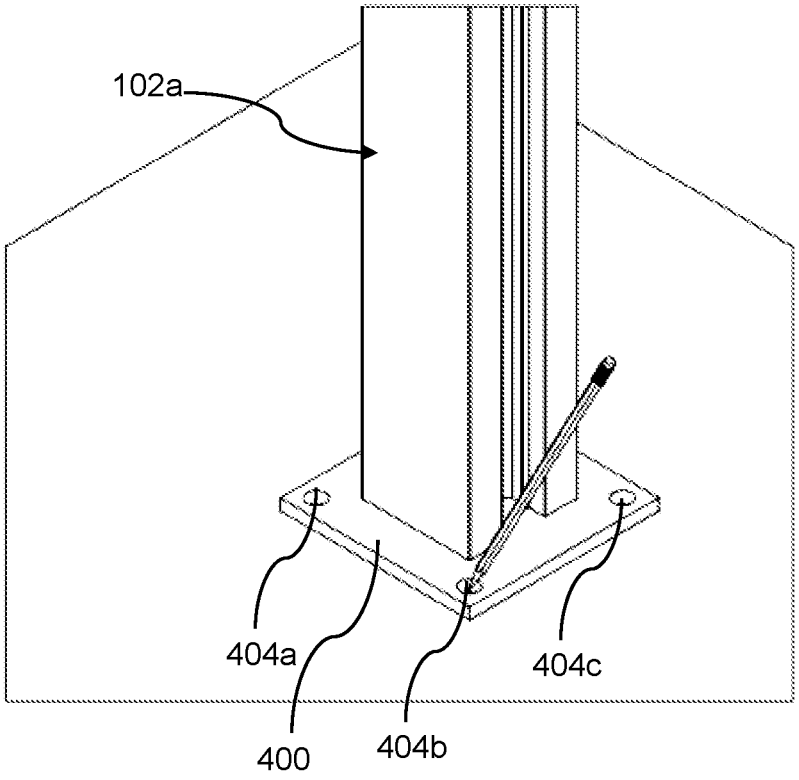
FIG. 4B illustrates a side perspective view of a first post installed on the base plate, according to an embodiment of the present invention.

FIG. 4B illustrates a side perspective view of the first post 102*a* installed on the base plate 400, according to an embodiment of the present invention. In an embodiment of the present invention, the base plate 400 that may be attached to the first post 102*a* may be drilled with a plurality of holes 404*a*-404*c* (hereinafter referred to as the holes 404) by using the drilling equipment to mount the base plate 400 and the first post 102*a* onto a surface. In a similar manner, the base plate 400 that may be attached to the second post 102*b* may be drilled with the holes 404 by using the drilling equipment to mount the base plate 400 and the second post 102*b* onto the surface. In an embodiment of the present invention, the holes 404 may be of any shape such as, but not limited to, a circular shape, the square shape, and so forth. Embodiments of the present invention are intended to include or otherwise cover any shape of the holes 404, including known, related art, and/or later developed technologies.

Figure 4C:
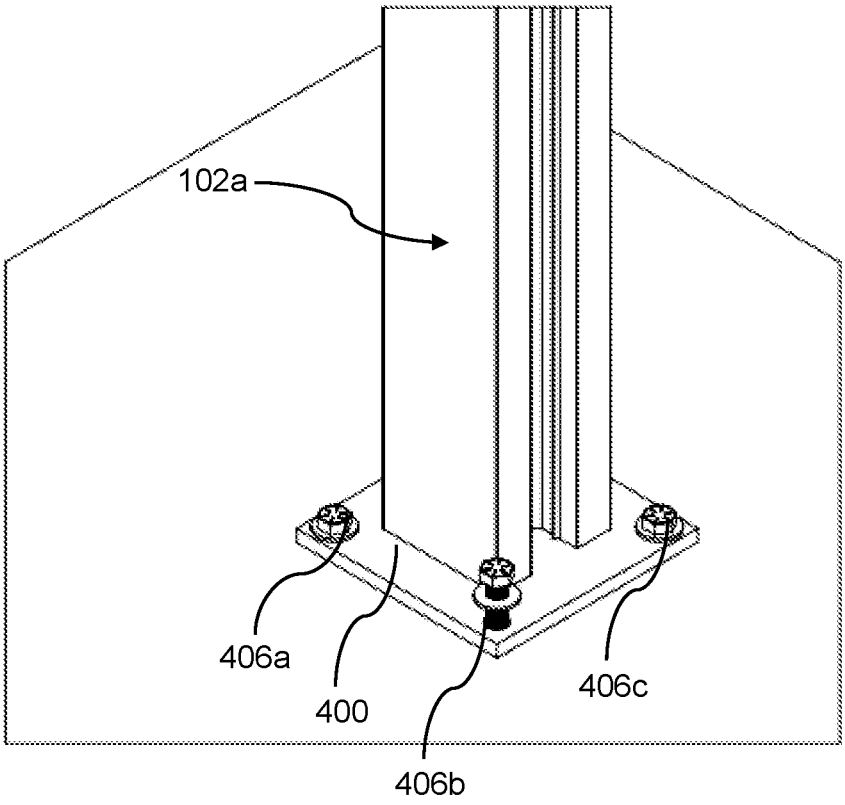
FIG. 4C illustrates a surface mounted installation of the first post, according to an embodiment of the present invention.

FIG. 4C illustrates a surface mounted installation of the first post 102*a*, according to an embodiment of the present invention. In an embodiment of the present invention, the holes 404 (as shown in the FIG. 4B) of the base plate 400 that may be installed at the bottom end of the first post 102*a* may be drilled to accept a plurality of corresponding fasteners 406*a*-406*c* (hereinafter referred to as the fasteners 406) for enabling the base plate 400 and the corresponding first post 102*a* to be attached to the surface. Similarly, the holes 404 of the base plate 400 that may be installed at the bottom end of the second post 102*b* may be drilled to accept the fasteners 406 for enabling the base plate 400 and the corresponding second post 102*b* to be attached to the surface. In an embodiment of the present invention, the base plate 400 may be fixedly attached to the surface. In another embodiment of the present invention, the base plate 400 may be removably attached to the surface. In an embodiment of the present invention, the fasteners 406 may be for example, but not limited to, bolts, rivets, anchors, and so forth. In a preferred embodiment of the present invention, the fasteners 406 may be screws. Embodiments of the present invention are intended to include or otherwise cover any type of the fasteners 406, including known, related art, and/or later developed technologies.

FIG. 4D illustrates a support member 408, according to an embodiment of the present invention. In a preferred embodiment of the present invention, the support member 408 may be a support foot that may be designed to provide a support to the lower rail 106 (as shown in the FIG. 1A). In an embodiment of the present invention, the first end of the lower rail 106 may be engaged with a groove of the first post 102*a* and the second end of the lower rail 106 may be engaged with a groove of the second post 102*b*. In another embodiment of the present invention, the support member 408 may be designed to provide a support to a first infill board of the infill boards 110 (as shown in the FIG. 1A), such that the first end of the first infill board of the infill boards 110 may be engaged with the groove of the first post 102*a* and the second end of the first infill board of the infill boards 110 may be engaged with the groove of the second post 102*b*. The support member 408 may be made up of a material such as, but not limited to, a stainless steel, a mild steel, and so forth. A zoomed partial view of support member 408 is illustrated in FIG. 4H. Embodiments of the present invention are intended to include or otherwise cover any type of the material for the support member 408, including known, related art, and/or later developed technologies.

FIG. 4E illustrates an installation of the support member 408, according to an embodiment of the present invention. The support member 408 may be installed inside the first post 102*a*, in an embodiment of the present invention. In a specific embodiment of the present invention, the support member 408 may be inserted from the top end of the first post 102*a* to install the support member 408 inside the first post 102*a*. Similarly, the support member 408 may also be inserted inside the second post 102*b*. According to an embodiment of the present invention, the support member 408 may comprise a plurality of support ribs 410*a*-410*n* (hereinafter referred to as the support ribs 410) that may be equipped at an outer surface of the support member 408. The support ribs 410 may be inserted into the groove of the first post 102*a* during an installation of the support member 408 into the first post 102*a*, in an embodiment of the present invention. Similarly, the support ribs 410 may be inserted into the groove of the second post 102*b* during the installation of the support member 408 into the second post 102*b*.

Figure 4F:
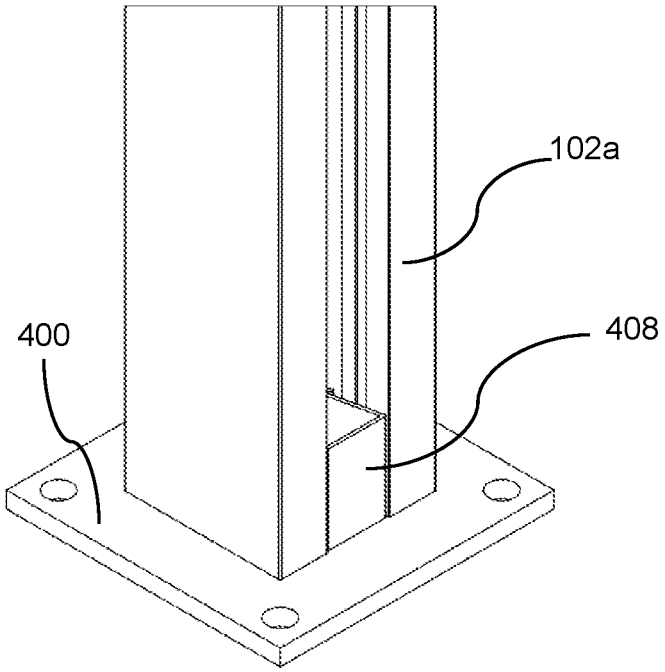
FIG. 4F illustrates a side perspective view of the support member installed within the first post, according to an embodiment of the present invention.

FIG. 4F illustrates a side perspective view of the support member 408 installed within the first post 102*a*, according to an embodiment of the present invention. The support member 408 may be slid down to the groove of the first post 102*a*, until the support member 408 rests on the base plate 400 of the first post 102*a*, in an embodiment of the present invention. Similarly, the support member 408 may be slid down to the groove of the second post 102*b*, until the support member 408 rests on the base plate 400 of the second post 102*b*.

Figure 4G:
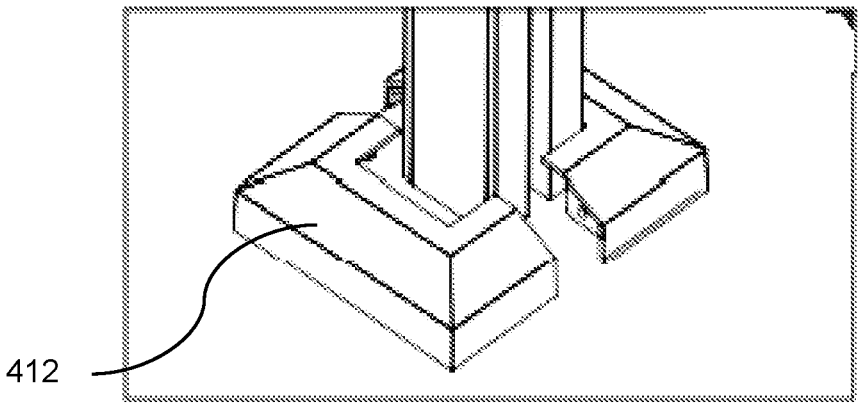
FIG. 4G illustrates a base plate cover, according to an embodiment of the present invention.

FIG. 4G illustrates a base plate cover 412 of the base plate 400, according to an embodiment of the present invention. The base plate cover 412 may be provided to cover the base plate 400 (as shown in the FIG. 4A), in an embodiment of the present invention. The base plate cover 412 may be having two parts, such that a first part of the two parts may be pushed from one side of the base plate 400 and a second part of the two parts may be pushed against the first part of the two parts to join the base plate cover 412 for covering the base plate 400 of the fence system 100. In an embodiment of the present invention, the base plate cover 412 may be made up of a material such as, but not limited to, a stainless steel, a plastic, rubber, and so forth. Embodiments of the present invention are intended to include or otherwise cover any type of the material of the base plate cover 412, including known, related art, and/or later developed technologies.

Figure 5A:
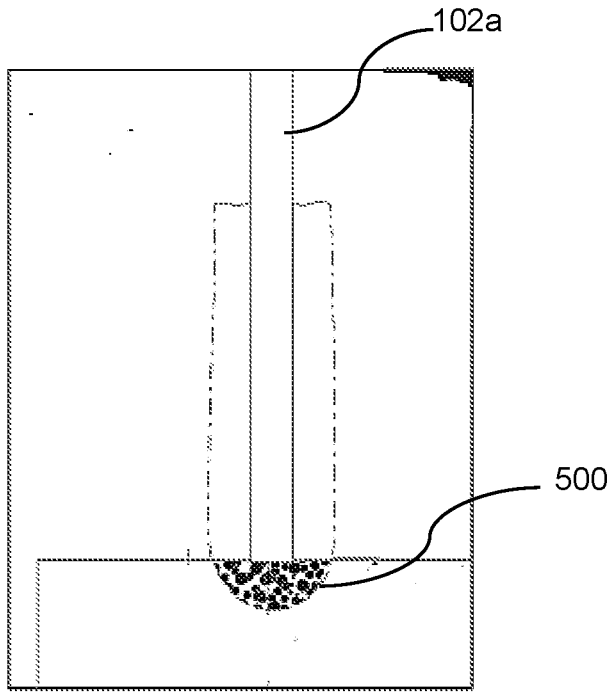
FIG. 5A illustrates an in-ground installation of the first post, according to an embodiment of the present invention.

FIG. 5A illustrates an in-ground installation of the first post 102*a*, according to an embodiment of the present invention. In an embodiment of the present invention, a first post hole 500 of a pre-defined diameter may be created till a specified frost line. In a preferred embodiment of the present invention, the pre-defined diameter may be 8 inches. In an embodiment of the present invention, a bottom portion of the first post hole 500 may be filled with a gravel and a top portion of the first post hole 500 may be filled with a concrete mixture that may be dry or wet based on pre-defined instructions. In an embodiment of the present invention, the first post 102*a* may further be inserted in the corresponding first post hole 500 at a pre-defined distance from a ground. In a preferred embodiment of the present invention, the pre-defined distance from the ground may be 2 inches. In an embodiment of the present invention, a height of the first post 102*a* from the ground may be in a range of 36 inches to 71 inches. In a preferred embodiment of the present invention, the height of the first post 102*a* may be 71 inches. Similarly, a second post hole (not shown) of the pre-defined diameter may be created till the specified frost line to insert the second post 102*b* into the second post hole.

Figure 5B:
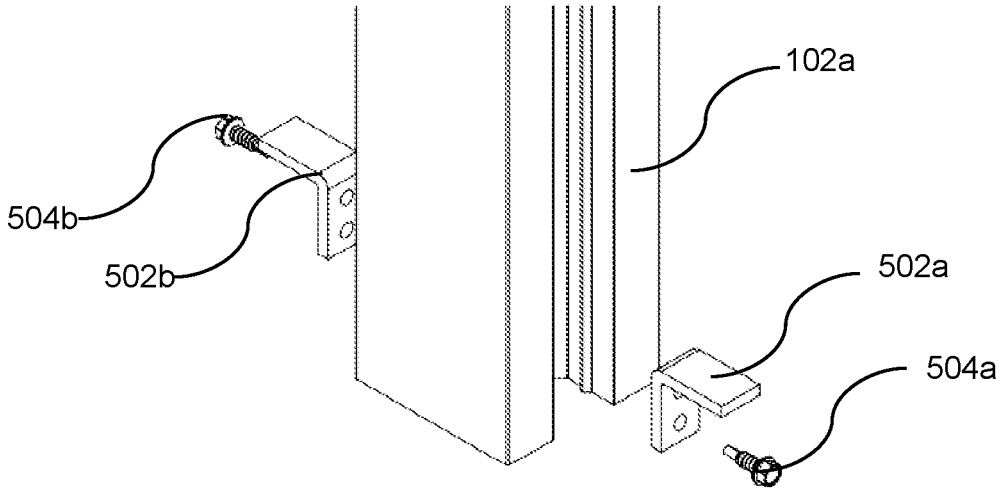
FIG. 5B illustrates a pair of bottom brackets, according to an embodiment of the present invention.

FIG. 5B illustrates a pair of bottom brackets 502*a*-502*b* (hereinafter referred to as the bottom brackets 502), according to an embodiment of the present invention. The bottom brackets 502 may be attached to both sides of the first post 102*a* for holding the first end of the lower rail 106 (as shown in the FIG. 1A), in an embodiment of the present invention. In another embodiment of the present invention, the bottom brackets 502 may be attached to the first post 102*a* for holding the first end of the first infill board of the infill boards 110 (as shown in the FIG. 1A). The bottom brackets 502 may be attached to the first post 102*a* through a first set of screws 504*a*-504*b* (hereinafter referred to as the first set of screws 504), in an embodiment of the present invention. In case of a line post, a first bottom bracket 502*a* of the bottom brackets 502 may be attached to a first side of the first post 102*a* using a first screw 504*a* of the first set of screws 504 and a second bottom bracket 502*b* of the bottom brackets 502 may be attached to a second side of the first post 102*a* using a second screw 504*b* of the first set of screws 504. In an embodiment of the present invention, the screws 504 may be attached to opposite holes of the corresponding bottom brackets 502, in case of the line posts. In an exemplary scenario, if one of the first set of screws 504 is attached to a first hole of the first bottom bracket 502*a* of the bottom brackets 502, then a corresponding screw of the first set of screws 504 may be attached to a second hole of the second bottom bracket 502*b* of the bottom brackets 502. Similarly, the bottom brackets 502 may be attached to the second post 102*b* to hold the second end of the one of, the lower rail 106 or the first infill board of the infill boards 110.

In an embodiment of the present invention, the bottom brackets 502 may be of any shape such as, but not limited to, a SS shape, a Z-shape, and so forth. In a preferred embodiment of the present invention, the bottom brackets 502 may be of a L-shape. Embodiments of the present invention are intended to include or otherwise cover any shape of the bottom brackets 502, including known, related art, and/or later developed technologies. Further, the first set of screws 504 may be, but not limited to, wood screws, machine screws, set screws, and so forth. Embodiments of the present invention are intended to include or otherwise cover any type of the first set of screws 504, including known, related art, and/or later developed technologies.

Figure 5C:
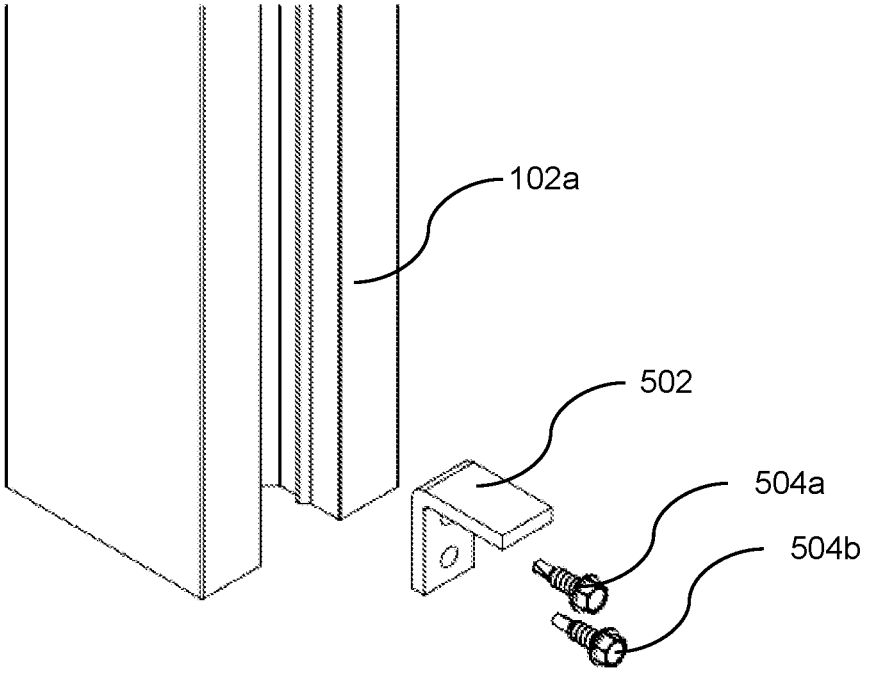
FIG. 5C illustrates the pair of bottom brackets, according to another embodiment of the present invention.

FIG. 5C illustrates the bottom brackets 502, according to another embodiment of the present invention. In case of the corner posts and the end posts, each of the bottom brackets 502 may require the first set of screws 504 to be attached to the first post 102*a*. In an exemplary scenario, the first bottom bracket 502*a* of the bottom brackets 502 may be attached to the first side of the first post 102*a* using the first set of screws 504 and the second bottom bracket 502*b* of the bottom brackets 502 may be attached to the second side of the second post 102*b* using the first set of screws 504. Similarly, each of the bottom brackets 502 may require the first set of screws 504 to be attached to the second post 102*b*.

Figure 6A:
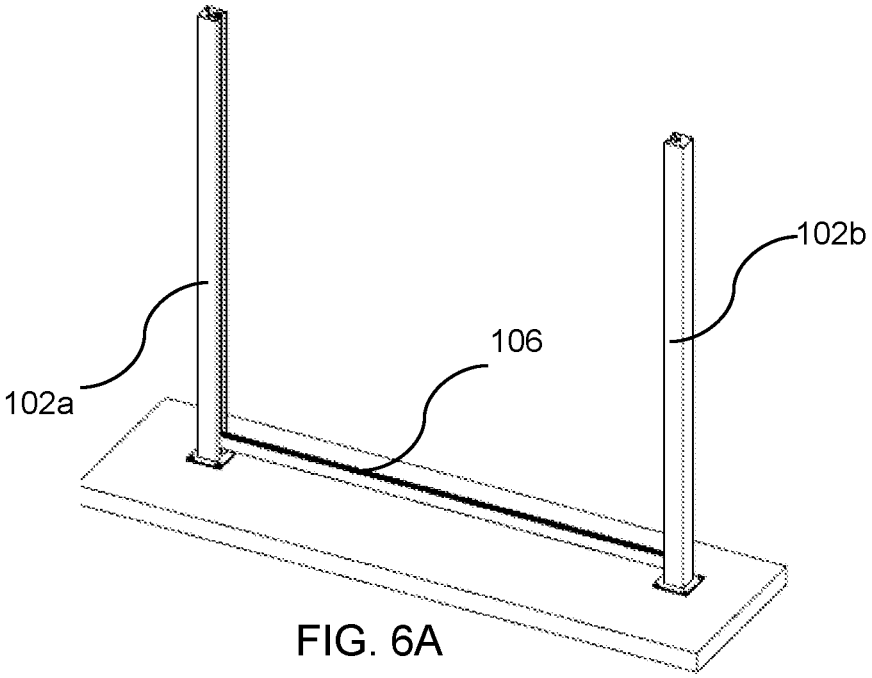
FIG. 6A illustrates a resting position of lower rail in between the first post and a second post, according to an embodiment of the present invention.

FIG. 6A illustrates a resting position of the lower rail 106 in between the first post 102*a* and the second post 102*b*, according to an embodiment of the present invention. The lower rail 106 may be installed into the groove of the each of the first post 102*a* and the second post 102*b*, as discussed above, in an embodiment of the present invention.

Figure 6B:
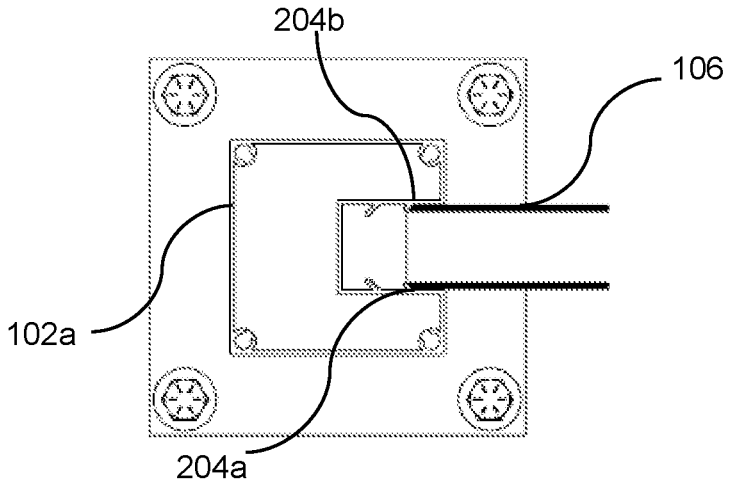
FIG. 6B illustrates a top view of the lower rail placed inside the first post, according to an embodiment of the present invention.

FIG. 6B illustrates a top view of the lower rail 106 placed inside the first post 102*a*, according to an embodiment of the present invention. The lower rail 106 may terminate at the face of the first set of ribs 204 of the first post 102*a*, upon installation of the lower rail 106 into the first post 102*a*, in an embodiment of the present invention.

Figure 6C:
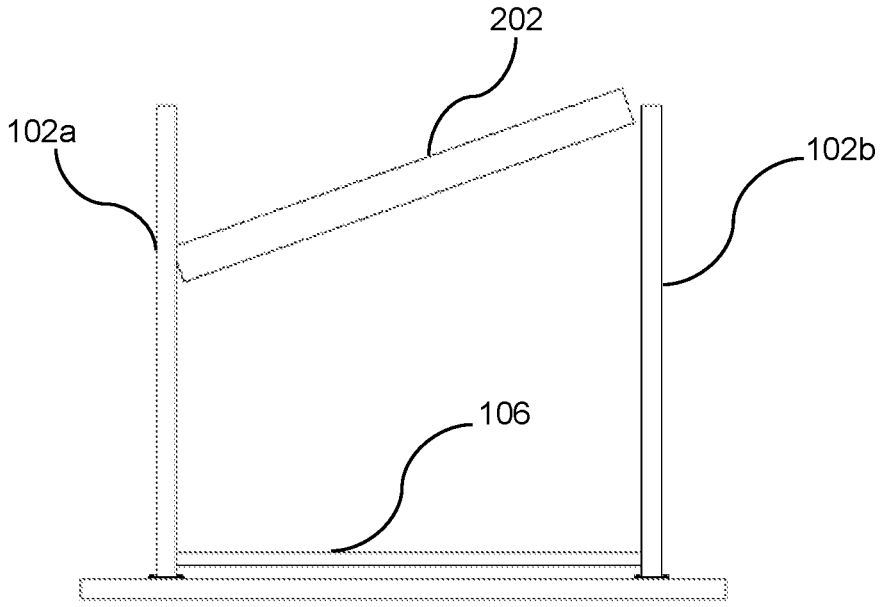
FIG. 6C illustrates an installation of a first wooden infill board in between the first post and the second post, according to an embodiment of the present invention.

FIG. 6C illustrates an installation of the first wooden infill board 202 in between the first post 102*a* and the second post 102*b*, according to an embodiment of the present invention. In an embodiment of the present invention, the first end of the first wooden infill board 202 may be installed into the groove of the first post 102*a* and the second end of the first wooden infill board 202 may be installed into the groove of the second post 102*b* over the lower rail 106 such that the first wooden infill board 202 may be nested completely in the lower rail 106. In another embodiment of the present invention, the first end of the first wooden infill board 202 may be installed into the groove of the first post 102*a* and the second end of the first wooden infill board 202 may be installed into the groove of the second post 102*b* without installing the lower rail 106. In an embodiment of the present invention, the first wooden infill board 202 may be installed in the horizontal orientation. According to an embodiment of the present invention, the pre-defined distance may be left from the first wooden infill board 202 to the ground. In a preferred embodiment of the present invention, the pre-defined distance may be 2 inches. In an embodiment of the present invention, the first post 102*a* and the second post 102*b* may be capable to fit the first wooden infill board 202 of a pre-defined size. In a preferred embodiment of the present invention, the pre-defined size may be 1 inch.

Figure 6D:
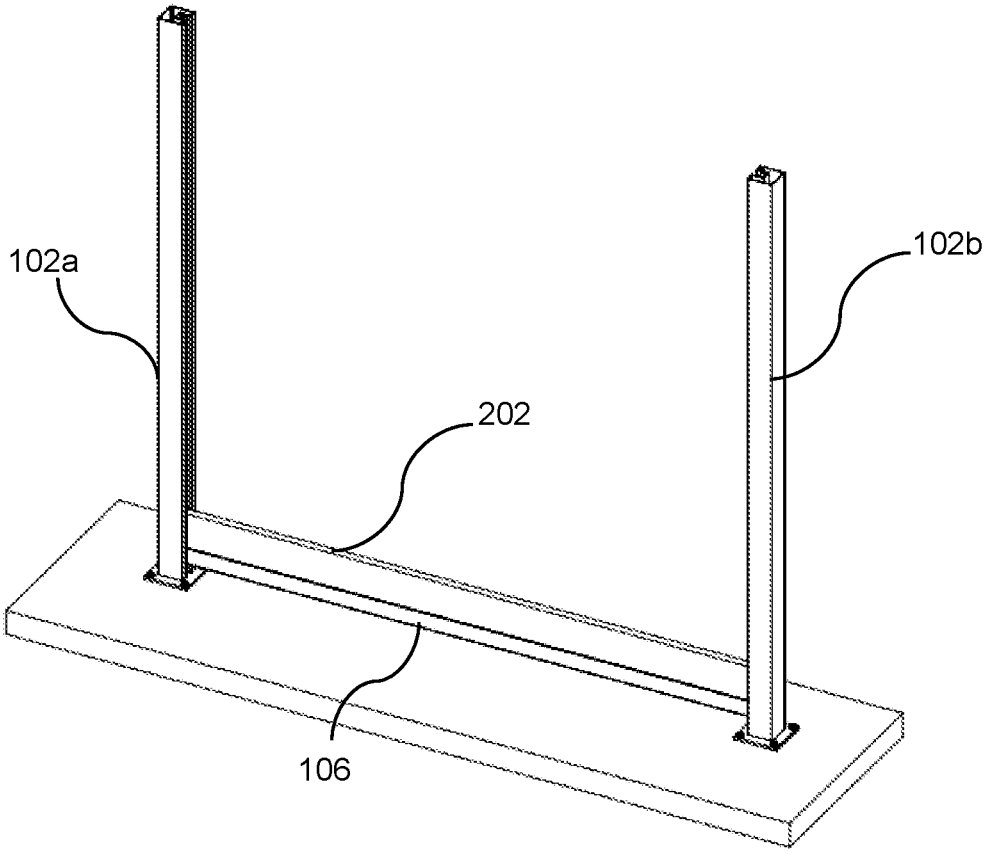
FIG. 6D illustrates a resting position of the lower rail and the first wooden infill board in between the first post and the second post, according to an embodiment of the present invention.

FIG. 6D illustrates a resting position of the lower rail 106 and the first wooden infill board 202 in between the first post 102*a* and the second post 102*b*, according to an embodiment of the present invention. The lower rail 106 may rest on the support member 408 (as shown in the FIG. 4D) that may be installed within the first post 102*a* and the second post 102*b*, in an embodiment of the present invention. In another embodiment of the present invention, the lower rail 106 may rest on the bottom brackets 502 (as shown in the FIG. 5B) that may be attached to both sides of the first post 102*a* and the second post 102*b*.

FIG. 6E illustrates the installation of the first wooden infill board 202, according to an embodiment of the present invention. In an embodiment of the present invention, the first wooden infill board 202 may be installed into the first post 102*a* and the second post 102*b* upon installation of the lower rail 106. According to an embodiment of the present invention, the first wooden infill board 202 may be nested in the lower rail 106, to enable a secure attachment of the first wooden infill board 202 to the each of the first post 102*a* and the second post 102*b*.

FIG. 6F illustrates an installation of the vinyl infill boards 302, according to an embodiment of the present invention. In an embodiment of the present invention, the vinyl infill boards 302 may be installed from the bottom to the top, if the vinyl infill boards 302 are installed in the horizonal orientation. In another embodiment of the present invention, the vinyl infill boards 302 may be installed from the first side to the second side, if the vinyl infill boards 302 are installed in the vertical orientation. In an embodiment of the present invention, the vinyl infill boards 302 may be nested in the rail 308, to enable the secure attachment of the vinyl infill boards 302 to the rail 308. FIG. 6O illustrates a partial top view of a vinyl infill board 302 secured within a rail 308.

Figure 6G:
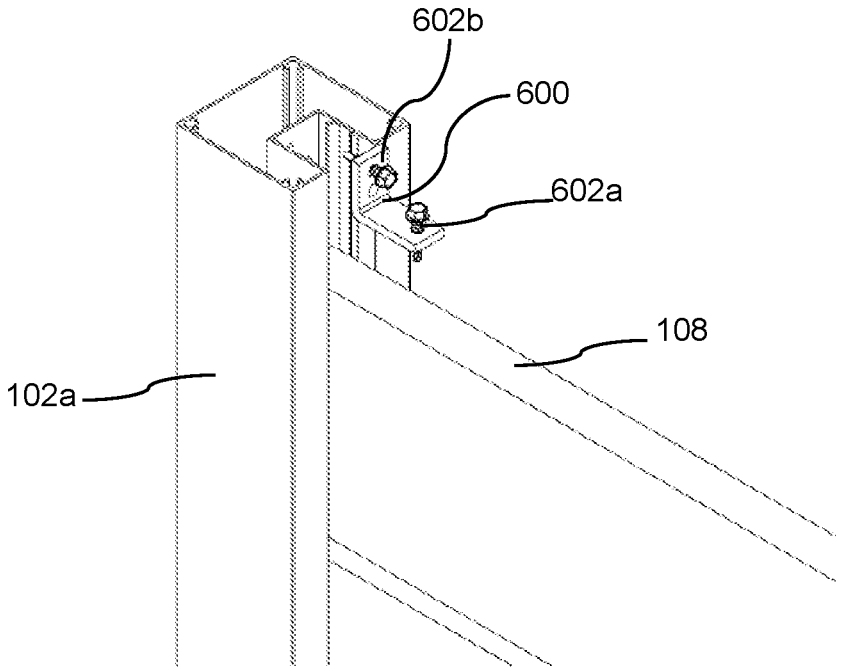
FIG. 6G illustrates an installation of a fastening means, according to an embodiment of the present invention.

FIG. 6G illustrates an installation of a fastening means 600 on the first post 102*a*, according to an embodiment of the present invention. In a preferred embodiment of the present invention, the fastening means 600 may be a top bracket that may be designed to provide a support to the upper rail 108, in an embodiment of the present invention. In an embodiment of the present invention, a first face of the fastening means 600 may be screwed into a vertical wall of the first post 102*a* and a second face of the fastening means 600 may be screwed into the upper rail 108 through a second set of screws 602*a*-602*b* (hereinafter referred to as the second set of screws 602). In an embodiment of the present invention, the fastening means 600 may be of any shape such as, but not limited to, the SS shape, the Z-shape, and so forth. In a preferred embodiment of the present invention, the fastening means 600 may be of the L-shape. Embodiments of the present invention are intended to include or otherwise cover any shape of the fastening means 600, including known, related art, and/or later developed technologies. The second set of screws 602 may be inserted into corresponding holes of the fastening means 600 that may be drilled by using the drilling equipment to securely attach the upper rail 108 to the first post 102*a*. Similarly, the fastening means 600 may be attached to the second post 102*b* through the second set of screws 602. The second set of screws 602 may be, but not limited to, machine screws, wood screws, sheet metal screws, and so forth. Embodiments of the present invention are intended to include or otherwise cover any type of the second set of screws 602, including known, related art, and/or later developed technologies.

Figure 6H:
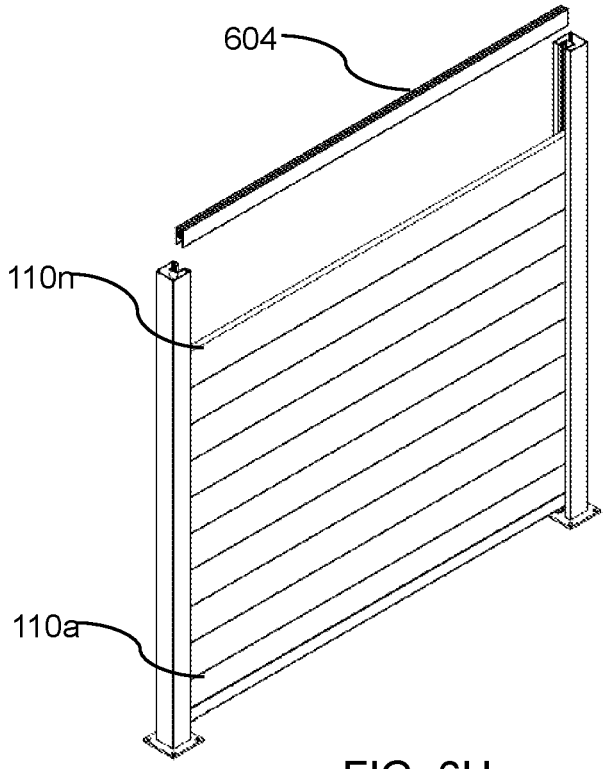
FIG. 6H illustrates an installation of a mid-rail between the first post and the second post, according to an embodiment of the present invention.

FIG. 6H illustrates a side perspective view of an installation of a mid-rail 604, according to an embodiment of the present invention. The mid-rail 604 may be installed horizontally over the infill boards 110, in an embodiment of the present invention. The mid-rail 604 may be made up of a material such as, but not limited to, a stainless steel, a brass, a copper, an aluminium, and so forth. Embodiments of the present invention are intended to include or otherwise cover any type of the material for the mid-rail 604, including known, related art, and/or later developed technologies.

Figure 6I:
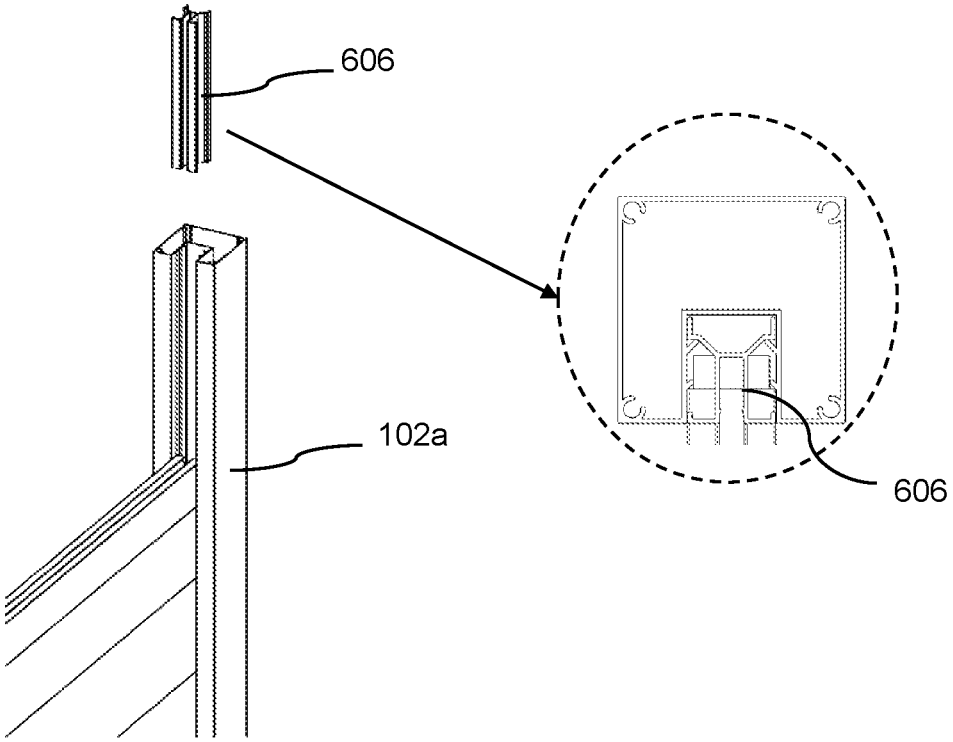
FIG. 6I illustrates an installation of a post adaptor, according to an embodiment of the present invention.

FIG. 6I illustrates an installation of a post adaptor 606, according to an embodiment of the present invention. The post adaptor 606 may be provided to be used with a Decorative Screen Panel (DSP) 608 (as shown in FIG. 6I). In an embodiment of the present invention, the post adapter 606 may be a Decorative Screen Panel (DSP) adaptor that may be inserted in either side of the top end of the first post 102*a* or the second post 102*b*. FIG. 6P illustrates a partial top zoomed-in view of a post adaptor 606 inserted in an end of a post 102.

Figure 6J:
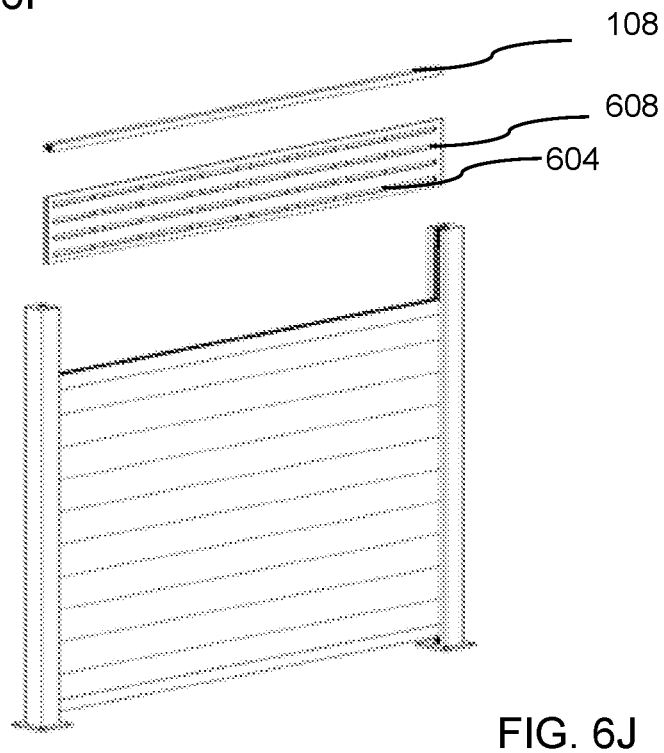
FIG. 6J illustrates an installation of a Decorative Screen Panel (DSP), according to an embodiment of the present invention.

FIG. 6J illustrates an installation of the Decorative Screen Panel (DSP) 608, according to an embodiment of the present invention. In an embodiment of the present invention, the Decorative Screen Panel (DSP) 608 may be of a full height or may be cut down to a desired height based on a requirement of the user. The Decorative Screen Panel (DSP) 608 may be inserted into the mid-rail 604 using the post adaptor 606 (as shown in the FIG. 6H), in an embodiment of the present invention. Further, the upper rail 108 may be securely attached to a top of the Decorative Screen Panel (DSP) 608 through the fastening means 600 (as shown in the FIG. 6F), in an embodiment of the present invention.

Figure 6K:
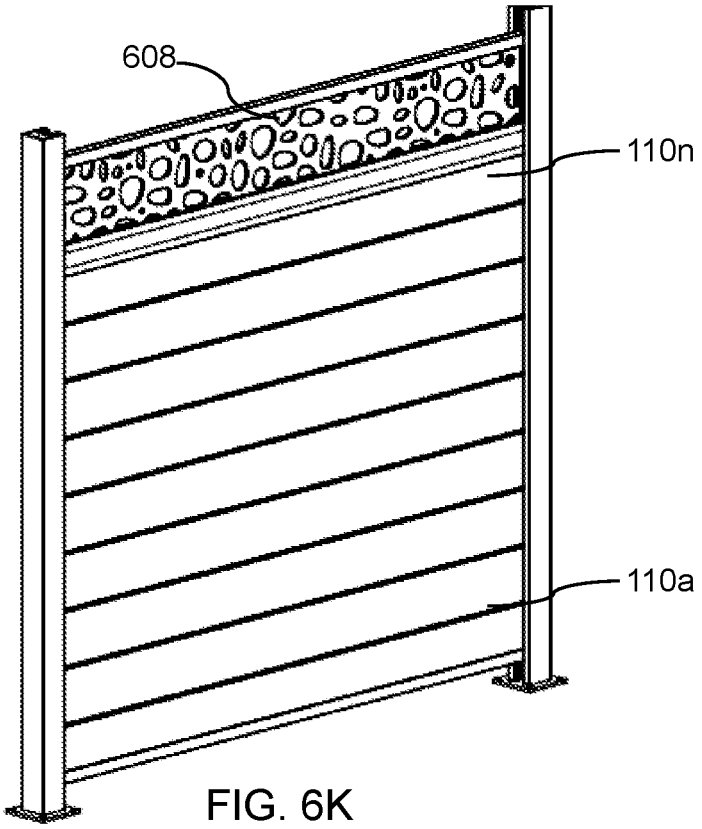
FIG. 6K illustrates the Decorative Screen Panel installed on horizontal infill boards, according to an embodiment of the present invention.

FIG. 6K illustrates the Decorative Screen Panel (DSP) 608 installed on the horizontal infill boards 110, according to an embodiment of the present invention. In a preferred embodiment of the present invention, the Decorative Screen Panel (DSP) 608 may comprise 3×6 DSP cut in thirds. In an embodiment of the present invention, the Decorative Screen Panel (DSP) 608 may be installed on the horizontal infill boards 110 that may be the wooden infill boards. In such embodiment of the present invention, a length of the Decorative Screen panel (DSP) 608 may be up to 68 inches. In another embodiment of the present invention, the Decorative Screen Panel (DSP) 608 may be installed on the horizontal infill boards 110 that may be the vinyl infill boards. In such embodiment of the present invention, the length of the Decorative Screen Panel (DSP) 608 may be up to 68 inches.

Figure 6L:
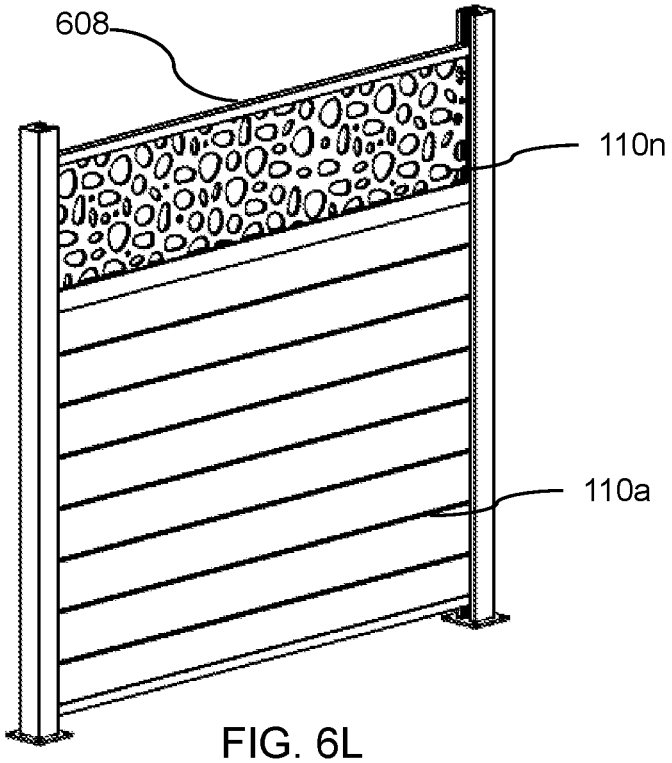
FIG. 6L illustrates the Decorative Screen Panel installed on the horizontal infill boards, according to another embodiment of the present invention.

FIG. 6L illustrates the Decorative Screen Panel (DSP) 608 installed on the horizontal infill boards 110, according to another embodiment of the present invention. In a preferred embodiment of the present invention, the Decorative Screen Panel (DSP) 608 may comprise 3×6 DSP cut in half.

Figure 6M:
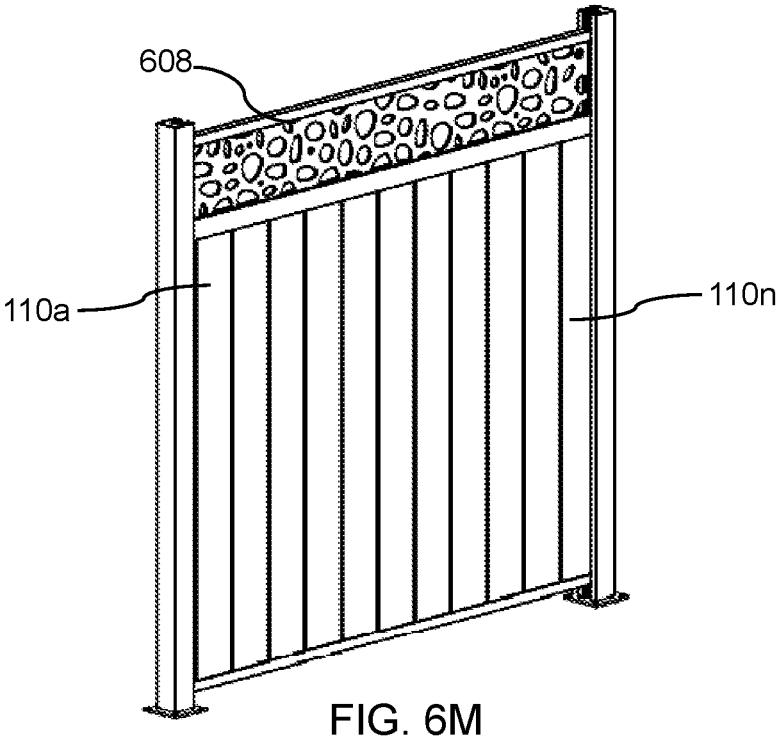
FIG. 6M illustrates the Decorative Screen Panel installed on vertical infill boards, according to an embodiment of the present invention.

FIG. 6M illustrates the Decorative Screen Panel (DSP) 608 installed on the vertical infill boards 110, according to an embodiment of the present invention. In a preferred embodiment of the present invention, the Decorative Screen Panel (DSP) 608 may comprise 3×6 DSP cut in thirds. In an embodiment of the present invention, the Decorative Screen Panel (DSP) 608 may be installed on the vertical infill boards 110 that may be the wooden infill boards. In such embodiment of the present invention, the length of the Decorative Screen Panel (DSP) 608 may be up to 68 inches. In another embodiment of the present invention, the Decorative Screen Panel (DSP) 608 may be installed on the vertical infill boards 110 that may be the vinyl infill boards. In such embodiment of the present invention, the length of the Decorative Screen Panel (DSP) 608 may be up to 68 inches.

Figure 6N:
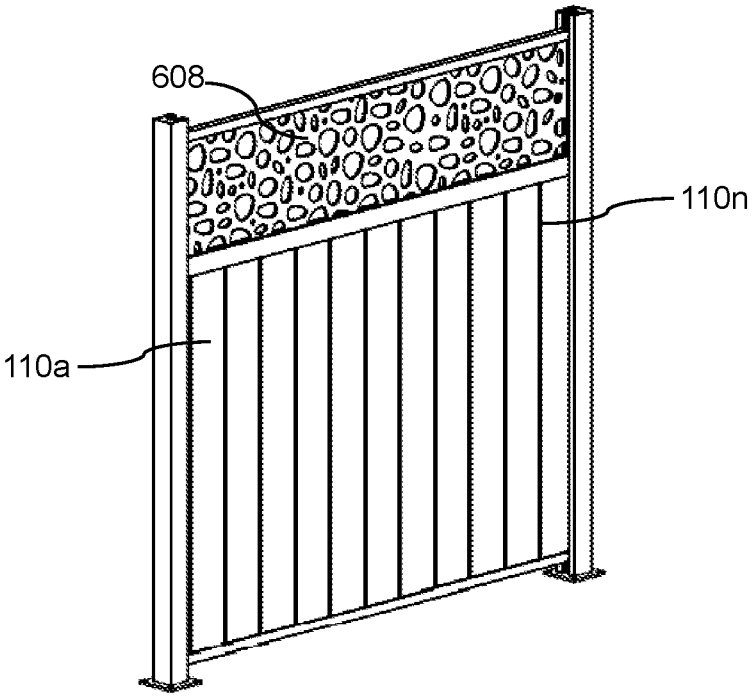
FIG. 6N illustrates the Decorative Screen Panel installed on the vertical infill boards, according to another embodiment of the present invention.

FIG. 6N illustrates the Decorative Screen Panel (DSP) 608 installed on the vertical infill boards 110, according to another embodiment of the present invention. In a preferred embodiment of the present invention, the Decorative Screen Panel (DSP) 608 may comprise 3×6 DSP cut in half.

Figure 7A:
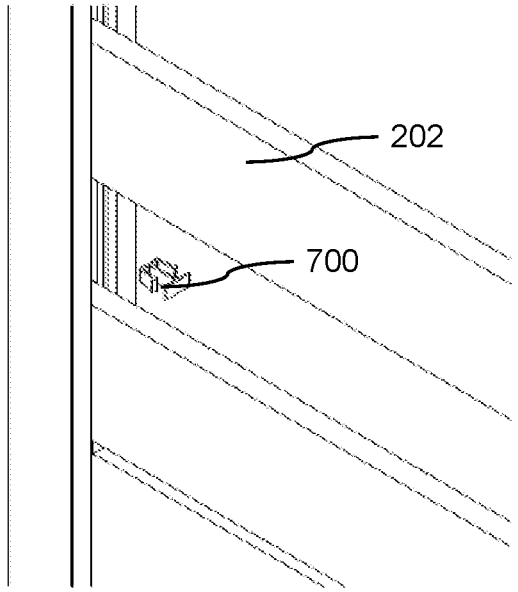
FIG. 7A illustrates a spacer to be installed between the infill boards, according to an embodiment of the present invention.

FIG. 7A illustrates a spacer 700 installed between the infill boards 202, according to an embodiment of the present invention. The spacer 700 may be installed after each of the wooden infill boards 202 that may be installed horizontally, to create a space in between the each of the wooden infill boards 202. The spacer 700 may be made up of a material such as, but not limited to, the plastic, a nylon, the metal, and so forth. Embodiments of the present invention are intended to include or otherwise cover any type of the material for the spacer 700, including known, related art, and/or later developed technologies.

Figure 7B:
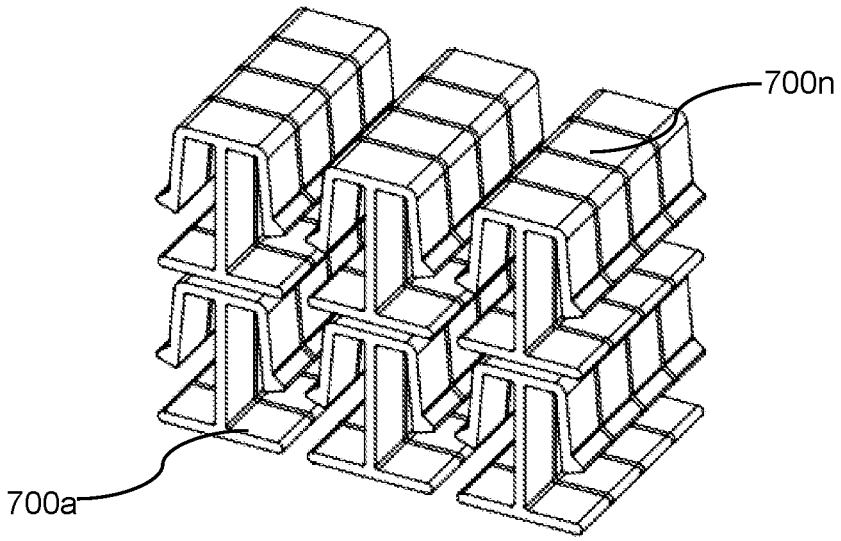
FIG. 7B illustrates a stack of a plurality of spacers, according to an embodiment of the present invention.

FIG. 7B illustrates a stack of a plurality of spacers 700*a*-700*n* (hereinafter referred to as the spacers 700), according to embodiments of the present invention. In an embodiment of the present invention, the spacers 700 may be provided with the surface mount posts that may be sold separately to add additional space. In another embodiment of the present invention, the spacers 700 may be purchased separately for use with the in-ground posts. In a preferred embodiment of the present invention, each of the spacers 700 may be having a size of 0.5 inches.

Figure 7C:
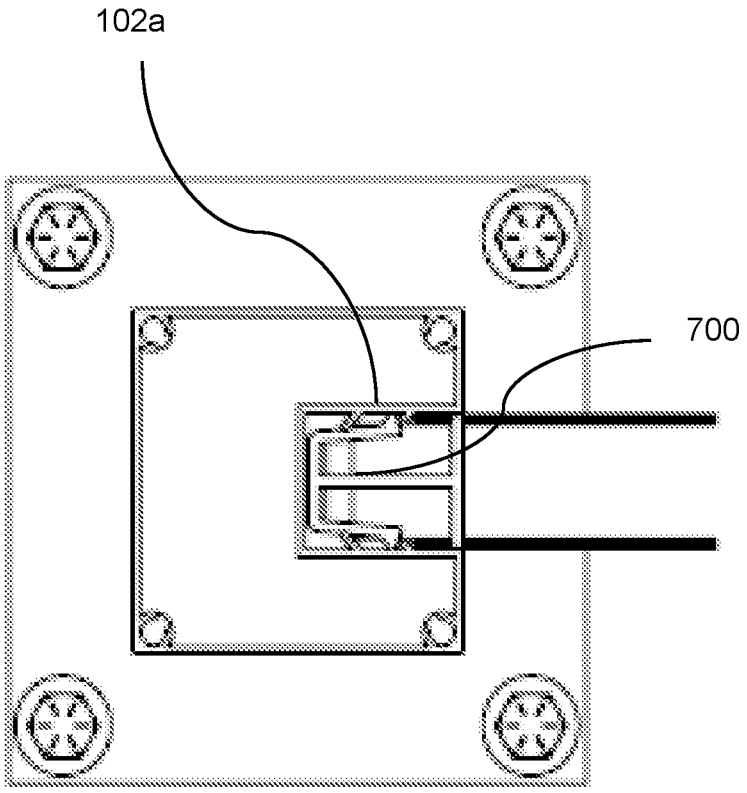
FIG. 7C illustrates an installation of the spacer in the first post, according to an embodiment of the present invention.

FIG. 7C illustrates an installation of the spacer 700, according to an embodiment of the present invention. In an embodiment of the present invention, the spacer 700 may be inserted into the first post 102*a* and may further fixed into the corresponding groove of the first post 102*a*. Similarly, the spacer 700 may be inserted into the second post 102*b* and may further fixed into the corresponding groove of the second post 102*b*.

Figure 8:
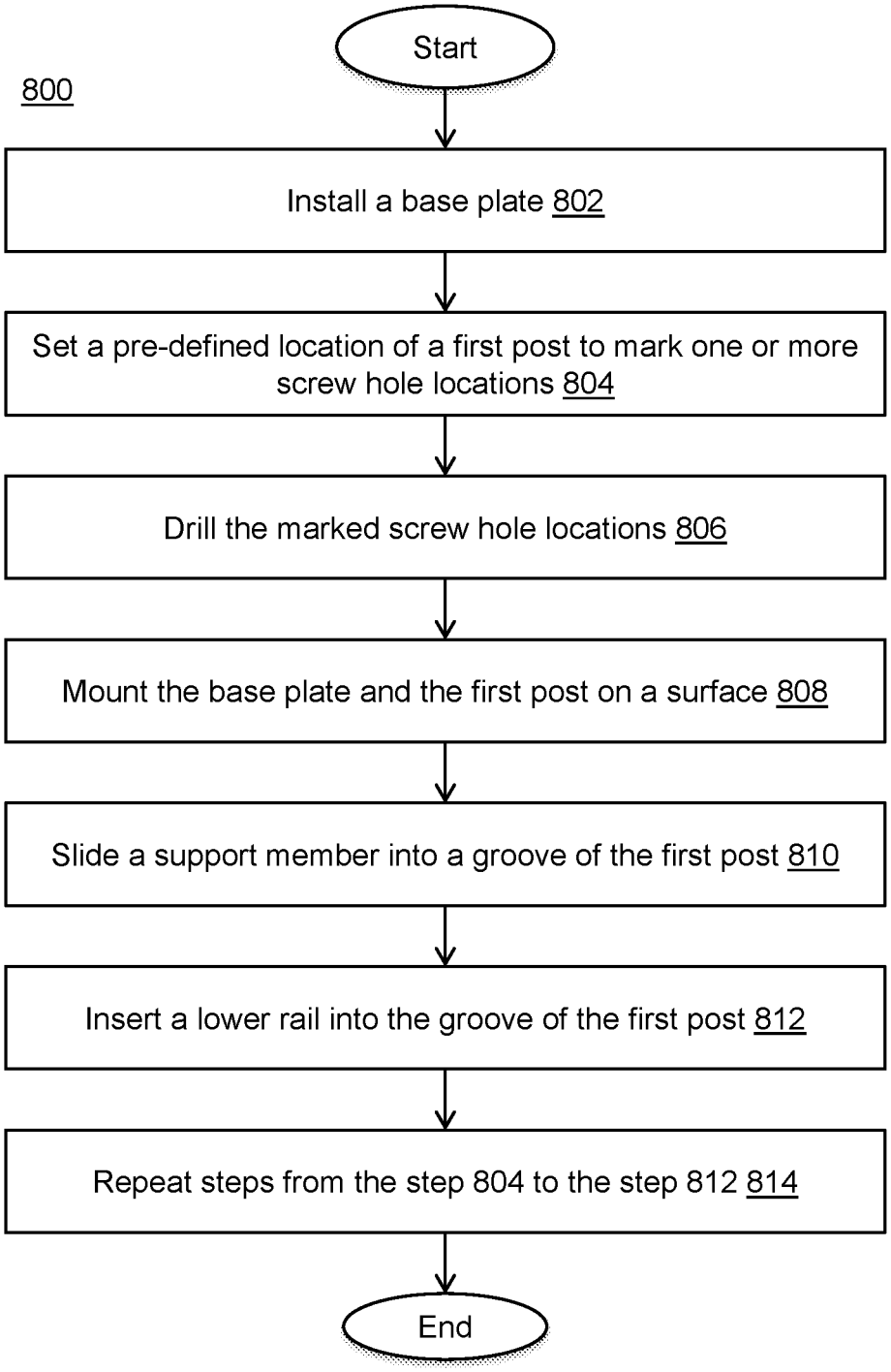
FIG. 8 illustrates a flow chart representing a method for the surface mounted installation of the first post and the second post, according to an embodiment of the present invention.

FIG. 8 illustrates a flow chart representing a method 800 for the surface mounted installation of the first post 102*a* and the second post 102*b*, according to an embodiment of the present invention.

At step 802, the base plate 400 may be installed at the bottom end of the first post 102*a* and the second post 102*b* through the screw bosses 402.

At step 804, the first post 102*a* may be set at a pre-defined location to mark one or more screw hole locations on a surface.

At step 806, the marked screw hole locations may be drilled by using the drilling equipment.

At step 808, the base plate 400 and the first post 102*a* may be mounted on the surface by using the fasteners 406.

At step 810, the support member 408 may be slid down to the groove of the first post 102*a* until the support member 408 rests on the base plate 400.

At step 812, the first end of the lower rail 106 may be inserted into the groove of the first post 102*a* to set the location of the second post 102*b*.

At step 814, the steps from 804 to 812 may be repeated for the surface mounted installation of the second post 102*b*.

Figure 9:
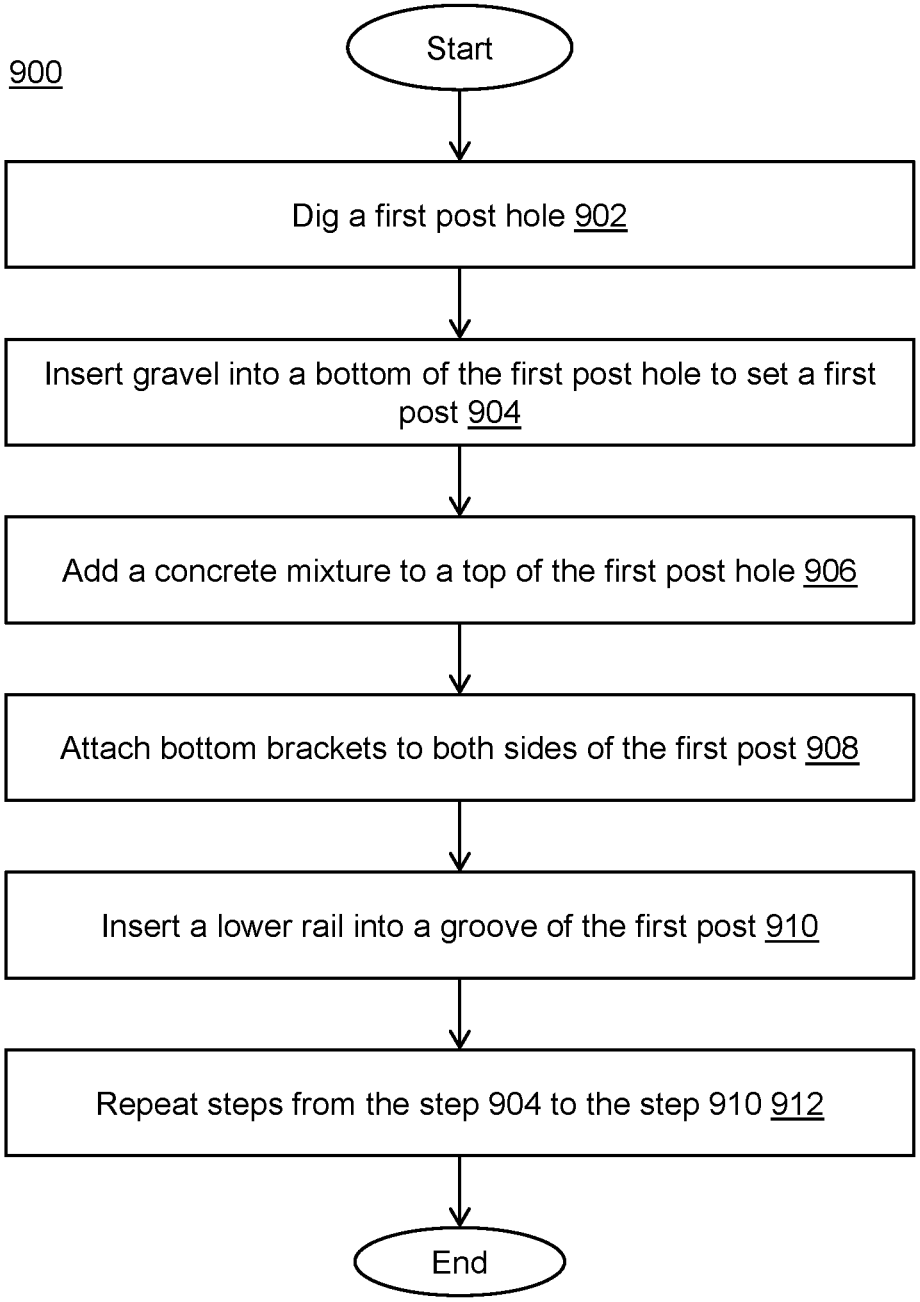
FIG. 9 illustrates a flow chart representing a method for the in-ground installation of the first post and the second post, according to an embodiment of the present invention.

FIG. 9 illustrates a flowchart representing a method 900 for the in-ground installation of the first post 102*a* and the second post 102*b*, according to an embodiment of the present invention.

At step 902, the first post hole 500 of the pre-defined diameter may be created till the frost line.

At step 904, the gravel may be inserted into the bottom of the first post hole 500 to set the first post 102*a* into the first post hole 500.

At step 906, the concrete mixture may be added to the top of the first post hole 500.

At step 908, the bottom brackets 502 may be attached to both sides of the first post 102*a* through the first set of screws 504.

At step 910, the first portion of the lower rail 106 may be inserted into the groove of the first post 102*a* to set the location of the second post 102*b*.

At step 912, the steps from 904 to 910 may be repeated for the in-ground installation of the second post 102*b*.

Figure 10:
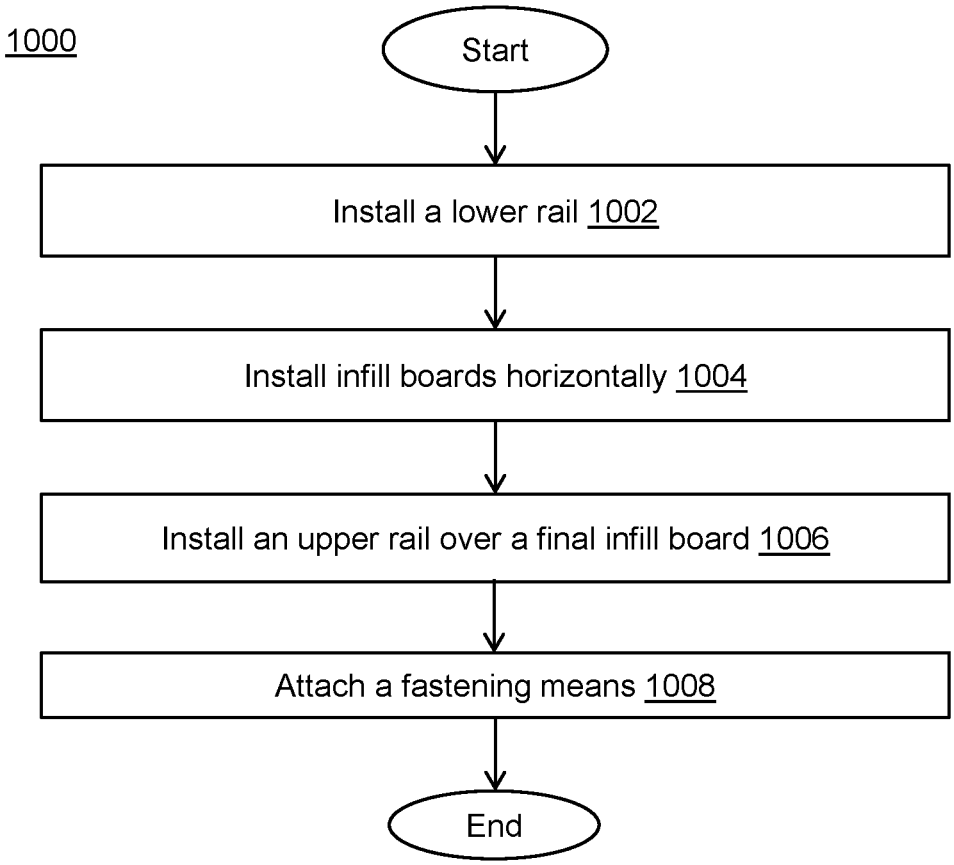
FIG. 10 illustrates a flow chart representing a method for installation of the infill boards in a horizontal orientation, according to an embodiment of the present invention.

FIG. 10 illustrates a flow chart representing a method 1000 for the horizontal installation of the infill boards 110, according to an embodiment of the present invention.

At step 1002, the lower rail 106 may be installed horizontally into the groove of the installed first post 102*a* and the installed second post 102*b*.

At step 1004, the infill boards 110 may be installed horizontally from the bottom, so that the infill boards 110 may be nested completely in the lower rail 106.

At step 1006, the upper rail 108 may be installed over the infill boards 110.

At step 1008, the fastening means 600 may be attached to the first post 102*a* and the second post 102*b* and the upper rail 108 by using the second set of screws 602 to secure the horizontal installation of the infill boards 110.

Figure 11:
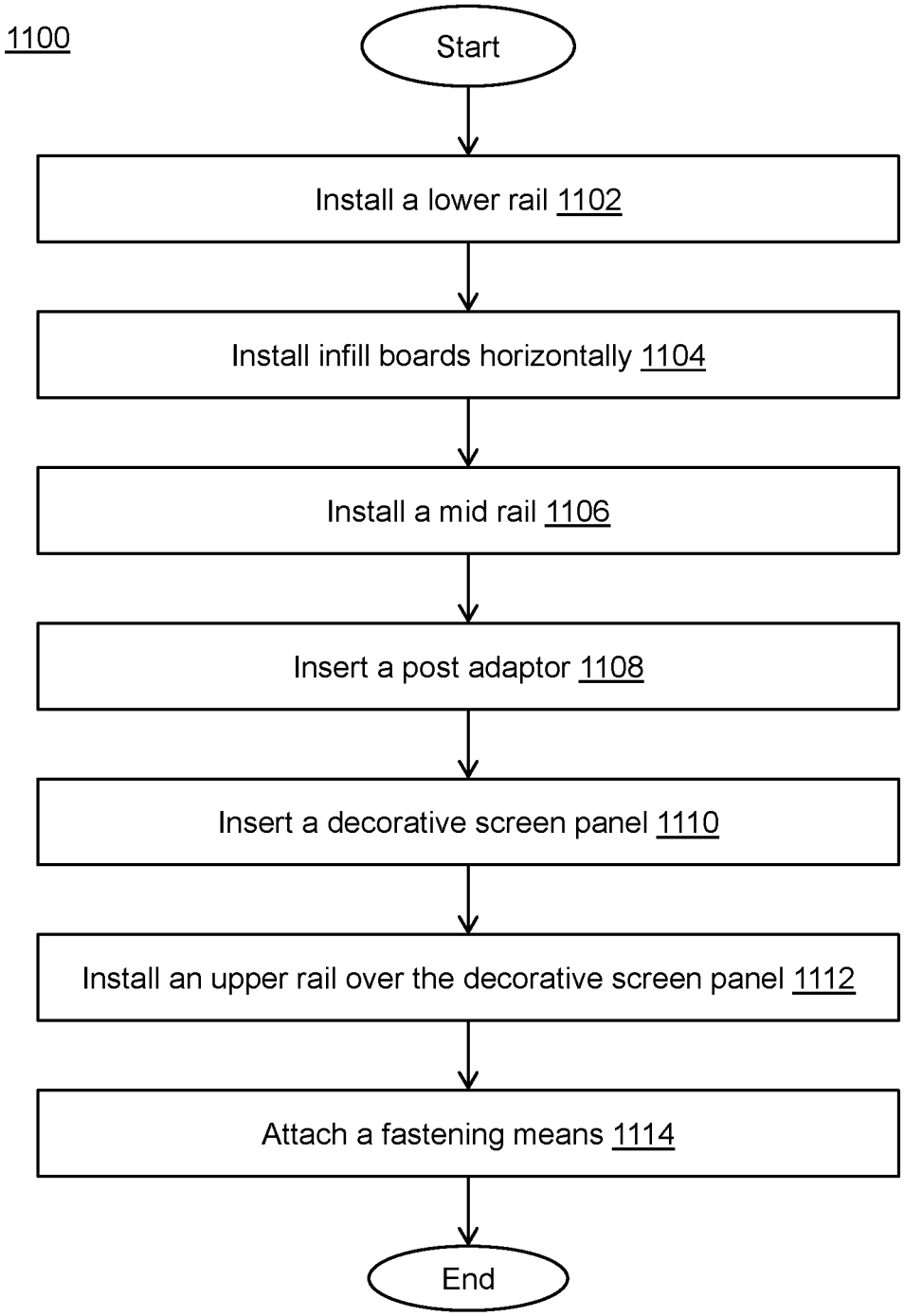
FIG. 11 illustrates a flow chart representing a method for installation of the infill boards in the horizontal orientation with the Decorative Screen Panel, according to an embodiment of the present invention.

FIG. 11 illustrates a flow chart representing a method 1100 for the horizontal installation of the infill boards 110 with the Decorative Screen Panel (DSP) 608, according to an embodiment of the present invention.

At step 1102, the lower rail 106 may be installed horizontally into the groove of the installed first post 102*a* and the installed second post 102*b*.

At step 1104, the infill boards 110 may be installed horizontally from the bottom, so that the infill boards 110 may be nested completely in the lower rail 106.

At step 1106, the mid-rail 604 may be installed horizontally over the horizontally installed infill boards 110.

At step 1108, the post adaptor 606 may be inserted in either side of the first post 102*a* or the second post 102*b*.

At step 1110, the Decorative Screen Panel (DSP) 608 may be inserted into the mid-rail 604 through the post adaptor 606.

At step 1112, the upper rail 108 may be installed over the Decorative Screen Panel (DSP) 608.

At step 1114, the fastening means 600 may be attached to the first post 102*a* and the second post 102*b* and the upper rail 108 by using the second set of screws 602 to secure the horizontal installation of the infill boards 110.

Figure 12:
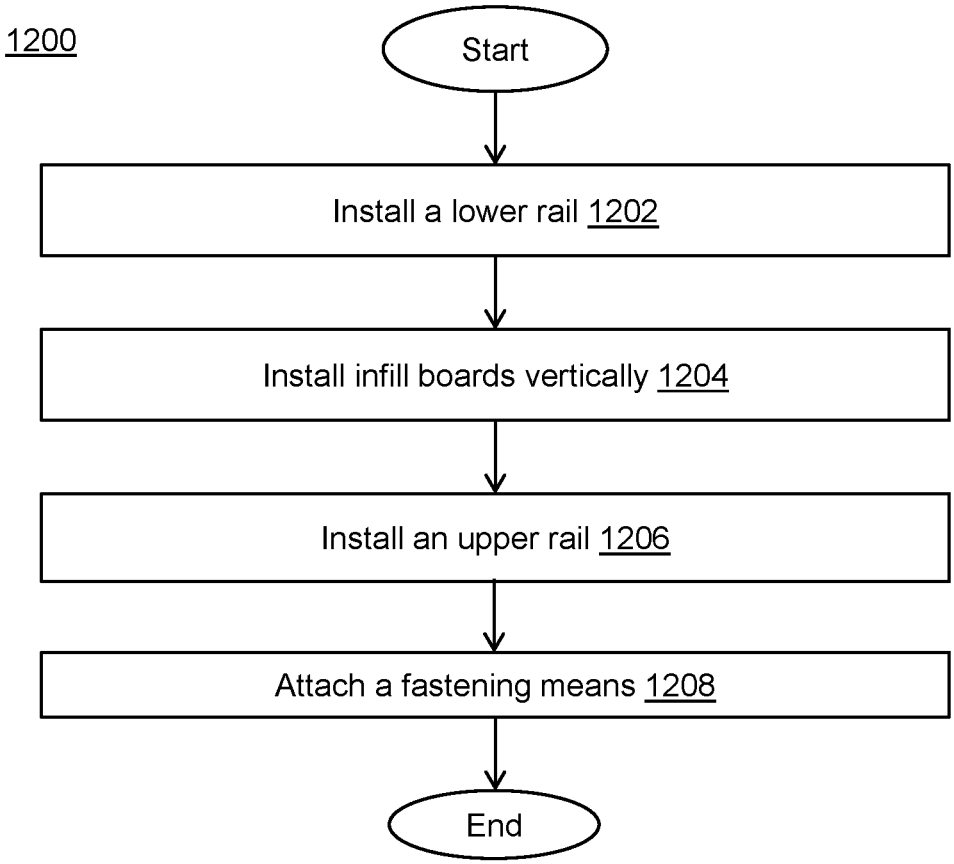
FIG. 12 illustrates a flow chart representing a method for installation of the infill boards in a vertical orientation, according to an embodiment of the present invention.

FIG. 12 illustrates a flowchart representing a method 1200 for the vertical installation of the infill boards 110, according to an embodiment of the present invention.

At step 1202, the lower rail 106 may be installed horizontally into the groove of the installed first post 102*a* and the installed second post 102*b*.

At step 1204, the infill boards 110 may be installed vertically from one side to another side, so that the infill boards 110 may be nested completely in the lower rail 106.

At step 1206, the upper rail 108 may be installed over the infill boards 110.

At step 1208, the fastening means 600 may be attached to the first post 102*a* and the second post 102*b* and the upper rail 108 by using the second set of screws 602 to secure the vertical installation of the infill boards 110.

Figure 13:
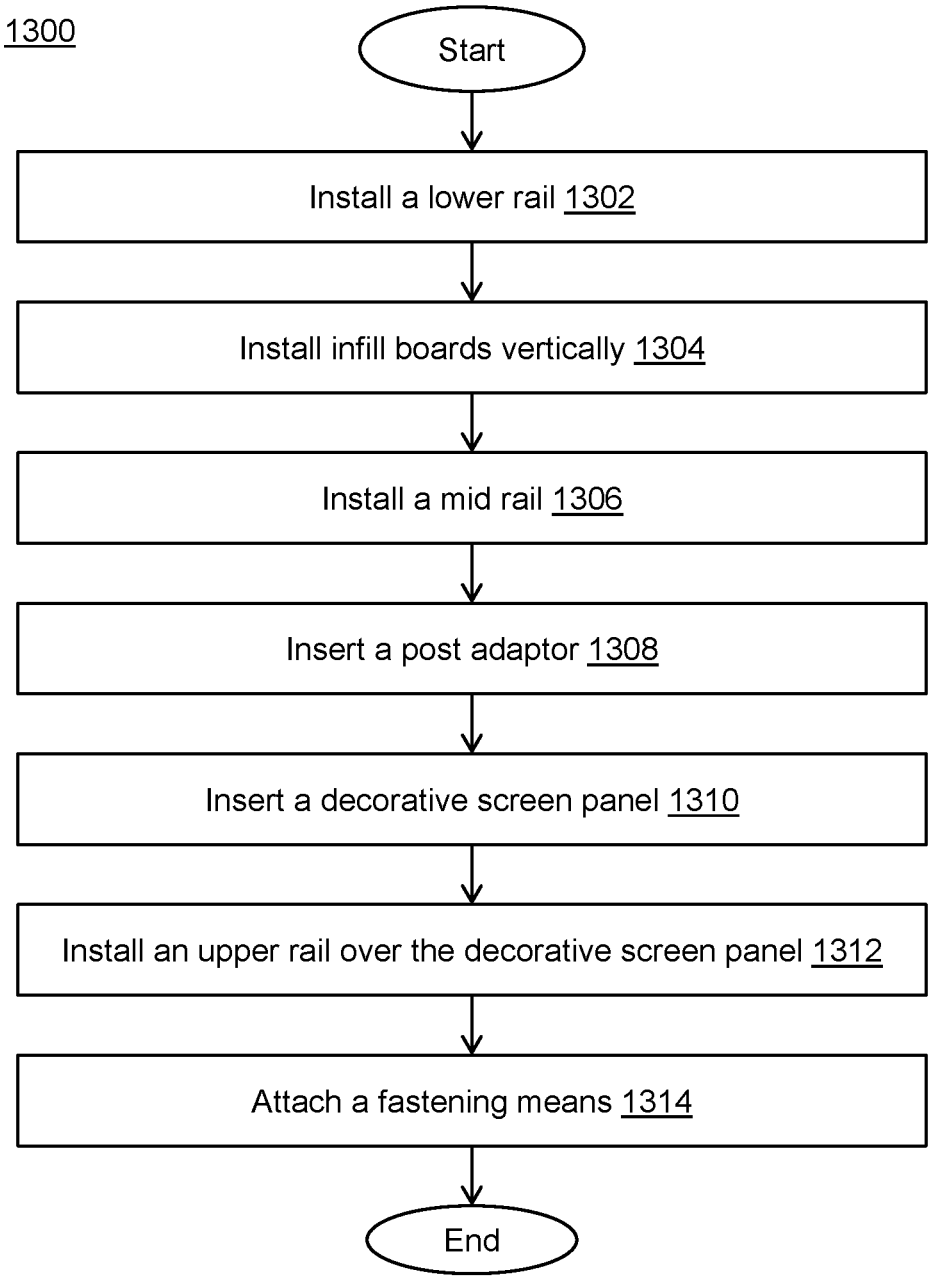
FIG. 13 illustrates a flow chart representing a method for installation of the infill boards in the vertical orientation with the Decorative Screen Panel, according to an embodiment of the present invention.

FIG. 13 illustrates a flowchart representing a method 1300 for the vertical installation of the infill boards 110 with the Decorative Screen panel (DSP) 608, according to an embodiment of the present invention.

At step 1302, the lower rail 106 may be installed horizontally into the groove of the installed first post 102*a* and the installed second post 102*b*.

At step 1304, the infill boards 110 may be installed vertically from one side to another side, so that the infill boards 110 may be nested completely in the lower rail 106.

At step 1306, the mid-rail 604 may be installed horizontally over the vertically installed infill boards 110.

At step 1308, the post adaptor 606 may be inserted in either side of the first post 102*a* or the second post 102*b*.

At step 1310, the Decorative Screen Panel (DSP) 608 may be inserted into the mid-rail 604 through the post adaptor 606.

At step 1312, the upper rail 108 may be installed over the Decorative Screen Panel (DSP) 608.

At step 1314, the fastening means 600 may be attached to the first post 102*a* and the second post 102*b* and the upper rail 108 by using the second set of screws 602 to secure the vertical installation of the infill boards 110.

Although the invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

The exemplary embodiments of this present invention have been described in relation to fence system. However, to avoid unnecessarily obscuring the present invention, the preceding description omits a number of known structures and devices. This omission is not to be construed as a limitation of the scope of the present invention. Specific details are set forth by use of the embodiments to provide an understanding of the present invention. It should however be appreciated that the present invention may be practiced in a variety of ways beyond the specific embodiments set forth herein.

A number of variations and modifications of the present invention can be used. It would be possible to provide for some features of the present invention without providing others.

The present invention, in various embodiments, configurations, and aspects, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving case and/or reducing cost of implementation.

The foregoing discussion of the present invention has been presented for purposes of illustration and description. It is not intended to limit the present invention to the form or forms disclosed herein. In the foregoing Detailed Description, for example, various features of the present invention are grouped together in one or more embodiments, configurations, or aspects for the purpose of streamlining the disclosure. The features of the embodiments, configurations, or aspects may be combined in alternate embodiments, configurations, or aspects other than those discussed above. This method of disclosure is not to be interpreted as reflecting an intention the present invention requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate embodiment of the present invention.

Moreover, though the description of the present invention has included description of one or more embodiments, configurations, or aspects and certain variations and modifications, other variations, combinations, and modifications are within the scope of the present invention, e.g., as may be within the skill and knowledge of those in the art, after understanding the present disclosure. It is intended to obtain rights which include alternative embodiments, configurations, or aspects to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

The invention claimed is:

1. A fence system, comprising:

a first rail provided at an initial position, wherein the first rail provides structural support to a plurality of boards;

a post positioned to be in contact with the first rail, wherein an interior portion of the post includes a first set of ribs and a second set of ribs, wherein each of the first set of ribs and second set of ribs are positioned within a groove of the post, wherein the first set of ribs is positioned at a first depth within the groove and the second set of ribs is positioned at a second depth within the groove greater than the first depth, and wherein each of the first set of ribs and second set of ribs are configured to project inward toward one or more interior regions of the groove;

a support member positioned within the groove configured to support the first rail, the support member including a plurality of support ribs provided on an outer surface, the support ribs positioned to cooperate with the second set of ribs; and a second rail in contact with the post, and positioned over the first rail, the second rail providing structural support for the plurality of boards.

2. The fence system of claim 1, wherein the first set of ribs and the second set of ribs are disposed on opposing sidewalls of the groove.

3. The fence system of claim 1, wherein ends of the first and second rails contact the post, wherein a second post is provided at and contacts opposite ends of the first and second rails.

4. The fence system of claim 1, wherein the second rail terminates at a face of the first set of ribs.

5. The fence system of claim 1, wherein the second rail extends in parallel to the first rail within the post.

6. The fence system of claim 1, wherein one or more of the plurality of boards terminate at a face of the second set of ribs.

7. The fence system of claim 1, wherein at least one board of the plurality of boards is configured to provide structural support to each of the first set of ribs and the second set of ribs within the post.

8. A fence system comprising:

a top rail provided over a plurality of boards, wherein the top rail is configured to secure the plurality of boards in a final position;

a post provided at an initial position, wherein the post includes a first set of ribs and a second set of ribs, wherein the first and second set of ribs extend in an inward direction within a groove, wherein the first set of ribs is positioned at a first depth and the second set of ribs is positioned at a second depth within the groove, the second depth greater than the first depth, and wherein the first set of ribs are positioned in contact with the top rail;

a support member positioned within the groove the support member including a plurality of support ribs provided on an outer surface, the support ribs positioned to cooperate with the second set of ribs; and a bottom rail provided underneath the top rail, wherein the bottom rail provides structural support for the post, first set of ribs, second set of ribs, and the plurality of boards.

9. The fence system of claim 8, wherein the top rail terminates at a face of the first set of ribs.

10. The fence system of claim 9, wherein the top rail provides structural support for the first set of ribs within the groove.

11. The fence system of claim 8, wherein at least one board of the plurality of boards are in contact with at least one of the first set of ribs or the second set of ribs.

12. The fence system of claim 8, wherein at least one board of the plurality of boards terminates at and is secured to a portion of the second set of ribs.

13. The fence system of claim 8, wherein the first set of ribs extend inward within the groove to be in contact with one or more of the plurality of boards.

14. A method of providing a fence, comprising:

providing a first rail at an initial position, wherein the first rail provides structural support to a plurality of boards;

positioning a post to be in contact with the first rail, wherein an interior portion of the post includes a first set of ribs and a second set of ribs, wherein each of the first set of ribs and second set of ribs are positioned within a groove of the post, wherein the first set of ribs is positioned at a first depth within the groove and the second set of ribs is positioned at a second depth within the groove greater than the first depth, and wherein each of the first set of ribs and the second set of ribs are configured to project inward toward one or more interior regions of the groove;

positioning a support member within the groove, the support member including a plurality of support ribs provided on an outer surface, the support ribs configured to cooperate with the second set of ribs; and providing a second rail in contact with the post, and positioned over the first rail, the second rail providing structural support for the plurality of boards.

15. The method of providing a fence of claim 14, further comprising:

positioning the second rail against a face of the first set of ribs.

16. The method of providing a fence of claim 14, further comprising:

wherein at least one of the first set of ribs and the second set of ribs is adjacent to at least one board of the plurality of boards.

17. The method of providing a fence of claim 14, further comprising:

wherein one end of at least one board of the plurality of boards is in a secured position with at least one of the first set of ribs and the second set of ribs to enable the at least one board of the plurality of boards to be engaged to the second rail within the post.

18. The method of providing a fence of claim 14, wherein the plurality of boards are secured within the post to provide privacy to one or more users.

19. The method of providing a fence of claim 14, further comprising:

wherein one or more boards of the plurality of boards extend to the second set of ribs within the post.

* * * * *